US009061185B2

(12) United States Patent
Dolezel et al.

(10) Patent No.: US 9,061,185 B2
(45) **Date of Patent: *Jun. 23, 2015**

(54) CORRELATED SET OF GOLF CLUB HEADS

(71) Applicant: DUNLOP SPORTS CO., LTD., Kobe (JP)

(72) Inventors: Keith F. Dolezel, Huntington Beach, CA (US); Sharon J. Park, Huntington Beach, CA (US); Ryan J. A. Ritchie, Huntington Beach, CA (US)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 81 days.

This patent is subject to a terminal disclaimer.

(21) Appl. No.: 13/622,146

(22) Filed: Sep. 18, 2012

(65) Prior Publication Data

US 2013/0072319 A1 Mar. 21, 2013

Related U.S. Application Data

(60) Provisional application No. 61/536,713, filed on Sep. 20, 2011.

(51) Int. Cl.

| | |
|---|---|
| ***A63B 53/04*** | (2006.01) |
| ***A63B 49/06*** | (2006.01) |
| *A63B 53/00* | (2015.01) |

(52) U.S. Cl.

CPC ..... *A63B 49/06* (2013.01); *A63B 53/04* (2013.01); *A63B 2053/005* (2013.01); (Continued)

(58) Field of Classification Search

CPC ..... A63B 53/047; A63B 2053/005; A63B 2054/0433

USPC ..... 473/290–291, 328, 350

See application file for complete search history.

(56) References Cited

U.S. PATENT DOCUMENTS

| | | | |
|---|---|---|---|
| D44,457 | S | 8/1913 | Taylor, Jr. |
| 1,089,881 | A | 3/1914 | Taylor, Jr. |

(Continued)

FOREIGN PATENT DOCUMENTS

| | | |
|---|---|---|
| EP | 0927563 A2 | 7/1999 |
| JP | A-7-313636 | 12/1995 |

(Continued)

OTHER PUBLICATIONS

Alien Golf Tutch Track Hybrid Sand Wedge, http://www.aliengolf.com/wedges-tutch-track-sand-wedge.html, May 21, 2011.

Cobra Golf S3 Max Irons, http://www.golfocd.com/cobra-s3-max-irons, Aug. 30, 2011.

Cobra Golf S2 Max Irons, http://www.golf.com/equipment/cobra-s2-max-irons, Jan. 13, 2010.

(Continued)

*Primary Examiner* — Stephen Blau

(74) *Attorney, Agent, or Firm* — Oliff PLC

(57) ABSTRACT

A correlated set of golf club heads is provided. The set of golf clubs has a first club head that, when oriented in a reference position, includes: a first loft angle, a first heel portion, a first toe portion opposite the first heel portion, a first top portion, and a first sole portion that comprises a first sole rail having a first setback length. The set of golf clubs also has a second club head that, when oriented in the reference position, includes: a second loft angle greater than the first loft angle, a second heel portion, a second toe portion opposite the second heel portion, a second top portion, and a second sole portion that comprises a second sole rail having a second setback length that is different from the first setback length.

20 Claims, 12 Drawing Sheets

(52) U.S. Cl.
CPC *A63B 2053/0433* (2013.01); *A63B 2053/0408* (2013.01); *A63B 2053/0479* (2013.01); *A63B 53/0466* (2013.01); *A63B 53/047* (2013.01)

(56) References Cited

U.S. PATENT DOCUMENTS

| | | | | | |
|---|---|---|---|---|---|
| 1,531,821 | A | | 3/1925 | Scott | |
| 1,669,482 | A | | 5/1928 | Miller | |
| D184,054 | S | | 12/1958 | Huthsing, Sr. | |
| 3,068,011 | A | | 12/1962 | Sano | |
| 3,655,188 | A | * | 4/1972 | Solheim | 473/290 |
| 3,862,759 | A | | 1/1975 | Evans et al. | |
| 3,961,796 | A | | 6/1976 | Thompson | |
| 3,984,103 | A | * | 10/1976 | Nix | 473/291 |
| D247,922 | S | | 5/1978 | Sheldon | |
| 4,180,269 | A | | 12/1979 | Thompson | |
| 4,332,388 | A | | 6/1982 | Crow | |
| D266,344 | S | | 9/1982 | Duclos | |
| 4,420,156 | A | * | 12/1983 | Campau | 473/291 |
| 4,645,207 | A | * | 2/1987 | Teramoto et al. | 473/290 |
| D298,269 | S | | 10/1988 | Flood | |
| D307,783 | S | | 5/1990 | Iinuma | |
| D310,254 | S | | 8/1990 | Take et al. | |
| D311,763 | S | | 10/1990 | Antonious | |
| 5,042,806 | A | | 8/1991 | Helmstetter | |
| D320,427 | S | | 10/1991 | Antonious | |
| D322,830 | S | | 12/1991 | Antonious | |
| D323,012 | S | | 1/1992 | Antonious | |
| D326,886 | S | | 6/1992 | Sun et al. | |
| 5,125,662 | A | * | 6/1992 | Antonious | 473/314 |
| 5,154,423 | A | | 10/1992 | Antonious | |
| 5,213,329 | A | | 5/1993 | Okumoto et al. | |
| D339,395 | S | | 9/1993 | Cameron | |
| 5,257,786 | A | | 11/1993 | Gorman | |
| D343,665 | S | | 1/1994 | Feche et al. | |
| 5,280,911 | A | | 1/1994 | Katayama | |
| D344,561 | S | | 2/1994 | Gorman | |
| D345,403 | S | | 3/1994 | Sanchez | |
| 5,295,686 | A | * | 3/1994 | Lundberg | 473/291 |
| 5,314,185 | A | | 5/1994 | Gorman | |
| 5,335,913 | A | | 8/1994 | White | |
| 5,340,106 | A | | 8/1994 | Ravaris | |
| D351,441 | S | | 10/1994 | Iinuma et al. | |
| D351,442 | S | | 10/1994 | Asabuki et al. | |
| D352,983 | S | | 11/1994 | Williams, Jr. | |
| D354,324 | S | | 1/1995 | Stites, III | |
| 5,380,009 | A | * | 1/1995 | Henry et al. | 473/346 |
| 5,390,924 | A | * | 2/1995 | Antonious | 473/328 |
| D357,521 | S | | 4/1995 | Wittrock | |
| 5,429,353 | A | * | 7/1995 | Hoeflich | 473/350 |
| D361,356 | S | | 8/1995 | Feche et al. | |
| D361,357 | S | | 8/1995 | Henry et al. | |
| 5,441,263 | A | | 8/1995 | Gorman | |
| D362,039 | S | | 9/1995 | Lin | |
| 5,451,056 | A | | 9/1995 | Manning | |
| D363,748 | S | | 10/1995 | Iinuma et al. | |
| D363,750 | S | | 10/1995 | Reed | |
| 5,456,469 | A | | 10/1995 | MacDougall | |
| D364,204 | S | | 11/1995 | Lin | |
| 5,465,970 | A | | 11/1995 | Adams et al. | |
| 5,467,988 | A | | 11/1995 | Henwood | |
| D366,508 | S | | 1/1996 | Hutin | |
| 5,497,995 | A | | 3/1996 | Swisshelm | |
| 5,516,106 | A | | 5/1996 | Henwood | |
| D371,183 | S | * | 6/1996 | Antonious | D21/748 |
| 5,524,890 | A | | 6/1996 | Kim et al. | |
| D371,816 | S | | 7/1996 | Yoshioka | |
| D373,164 | S | | 8/1996 | Wang | |
| 5,544,884 | A | | 8/1996 | Hardman | |
| 5,547,188 | A | | 8/1996 | Dumontier et al. | |
| D375,535 | S | | 11/1996 | Gorman | |
| 5,573,469 | A | | 11/1996 | Dekura | |
| D377,509 | S | | 1/1997 | Katayama | |
| 5,603,668 | A | * | 2/1997 | Antonious | 473/328 |
| 5,607,365 | A | | 3/1997 | Wolf | |
| 5,643,107 | A | | 7/1997 | Gorman | |
| 5,658,206 | A | | 8/1997 | Antonious | |
| D383,181 | S | | 9/1997 | Gorman | |
| D385,607 | S | | 10/1997 | Adams | |
| 5,690,556 | A | | 11/1997 | Condon | |
| 5,704,851 | A | | 1/1998 | Lucetti | |
| 5,735,754 | A | | 4/1998 | Antonious | |
| 5,762,566 | A | | 6/1998 | King et al. | |
| D396,512 | S | | 7/1998 | Besnard et al. | |
| 5,779,565 | A | | 7/1998 | Adams | |
| 5,785,609 | A | | 7/1998 | Sheets et al. | |
| D397,387 | S | | 8/1998 | Allen | |
| D398,681 | S | | 9/1998 | Galy | |
| 5,803,830 | A | | 9/1998 | Austin et al. | |
| 5,813,919 | A | | 9/1998 | Best et al. | |
| D399,898 | S | | 10/1998 | Stone et al. | |
| D401,300 | S | | 11/1998 | Albright | |
| D410,057 | S | | 5/1999 | Ortiz | |
| 5,916,041 | A | | 6/1999 | Antonious | |
| 5,931,745 | A | | 8/1999 | Adams | |
| 5,938,538 | A | | 8/1999 | Broadbridge et al. | |
| 5,954,595 | A | | 9/1999 | Antonious | |
| 5,967,902 | A | | 10/1999 | Greenquist et al. | |
| 5,976,033 | A | | 11/1999 | Takeda | |
| 5,989,134 | A | | 11/1999 | Antonious | |
| 6,056,649 | A | * | 5/2000 | Imai | 473/328 |
| D426,268 | S | | 6/2000 | Ortiz | |
| D426,602 | S | | 6/2000 | Polk, III et al. | |
| D426,603 | S | | 6/2000 | Besnard et al. | |
| 6,123,627 | A | | 9/2000 | Antonious | |
| D435,075 | S | | 12/2000 | Ota | |
| 6,179,726 | B1 | * | 1/2001 | Satoh et al. | 473/290 |
| D442,244 | S | | 5/2001 | Olsavsky et al. | |
| 6,257,991 | B1 | | 7/2001 | Ortiz | |
| D446,567 | S | | 8/2001 | Nagai et al. | |
| RE37,647 | E | | 4/2002 | Wolf | |
| D457,212 | S | | 5/2002 | Yamane et al. | |
| D457,583 | S | * | 5/2002 | Olsavsky et al. | D21/752 |
| 6,416,422 | B1 | * | 7/2002 | Nagai et al. | 473/328 |
| D461,865 | S | | 8/2002 | Nagai et al. | |
| 6,530,847 | B1 | | 3/2003 | Antonious | |
| D472,950 | S | | 4/2003 | Burnett et al. | |
| D473,276 | S | | 4/2003 | Kenmi | |
| D478,950 | S | | 8/2003 | Herber | |
| D479,291 | S | | 9/2003 | Murray | |
| D480,441 | S | | 10/2003 | Kenmi | |
| D481,090 | S | | 10/2003 | Antonious | |
| D481,091 | S | | 10/2003 | Antonious | |
| 6,663,503 | B1 | | 12/2003 | Kenmi | |
| 6,780,121 | B2 | | 8/2004 | Herber | |
| D499,157 | S | | 11/2004 | Antonious | |
| D502,238 | S | | 2/2005 | Baiocchi | |
| 6,855,068 | B2 | | 2/2005 | Antonious | |
| D523,508 | S | | 6/2006 | Shenoha | |
| D526,036 | S | | 8/2006 | Nishitani | |
| D531,245 | S | | 10/2006 | Shenoha | |
| D532,850 | S | | 11/2006 | Oldknow | |
| 7,147,570 | B2 | * | 12/2006 | Toulon et al. | 473/290 |
| D534,976 | S | | 1/2007 | Glod | |
| D538,368 | S | | 3/2007 | Rollinson et al. | |
| 7,618,330 | B2 | | 11/2009 | Krewalk et al. | |
| D627,843 | S | | 11/2010 | Kuan et al. | |
| D627,844 | S | | 11/2010 | Kuan et al. | |
| D638,894 | S | | 5/2011 | Potter | |
| D639,881 | S | | 6/2011 | Breier et al. | |
| D639,884 | S | | 6/2011 | Breier et al. | |
| 2004/0018891 | A1 | | 1/2004 | Antonious | |
| 2005/0049073 | A1 | | 3/2005 | Herber | |
| 2006/0094526 | A1 | * | 5/2006 | Reed | 473/328 |
| 2006/0240905 | A1 | | 10/2006 | Haney et al. | |
| 2007/0142120 | A1 | | 6/2007 | Krewalk et al. | |
| 2011/0077101 | A1 | | 3/2011 | Bennett et al. | |

FOREIGN PATENT DOCUMENTS

| | | |
|---|---|---|
| JP | A-10-263117 | 10/1998 |
| JP | A-11-9737 | 1/1999 |

(56) References Cited

FOREIGN PATENT DOCUMENTS

| | | |
|---|---|---|
| JP | A-11-104282 | 4/1999 |
| JP | A-2003-334266 | 11/2003 |
| WO | WO 2004022171 A1 * | 3/2004 |

OTHER PUBLICATIONS

Cobra Baffler Rail H Hybrid, http://www.golf.com/equipment/cobra-baffler-rail-h-hybrid, Mar. 23, 2010.

* cited by examiner

CORRELATED SET OF GOLF CLUB HEADS

This nonprovisional application claims the benefit of U.S. Provisional Application No. 61/536,713, filed Sep. 20, 2011. The disclosure of the prior application is hereby incorporated by reference herein in its entirety.

COPYRIGHT AUTHORIZATION

The disclosure below may be subject to copyright protection. The copyright owner has no objection to the facsimile reproduction by any one of the documents containing this disclosure, as they appear in the Patent and Trademark Office records, but otherwise reserves all applicable copyrights.

BACKGROUND OF THE INVENTION

Golf clubs of all types generally have a golf club head that has a sole portion. The sole portion of the golf club head interacts with the ground on most golf shots. Such interaction with the ground is commonly known as turf interaction.

It is generally desirable to control the degree of turf interaction, for example by minimizing the amount of interaction between the golf club head and the ground during a golf shot, particularly for low-lofted clubs. For example, in a case where a golf ball has a "bad" lie, i.e. where the turf is long, the turf will impede the golf club head during the golf shot, thereby reducing a club head speed of the golf club head, which in turn reduces shot distance. Further, the turf may deflect the club head during the course of a swing, negatively affecting the orientation of a striking face of the club head at the point of impact. In other cases, the golf ball may be on an uneven lie, a turf-less lie, a hard-pan lie, a wet lie, or even a good lie in a fairway (where the turf is short). Any of these varying lies could have a negative effect on an outcome of a golf shot by imparting drag on the golf club head or deflecting the golf club head as it However, configuring sole structure to control turf interaction may have unintended consequences. For example, configuring a sole portion of club head to control turf interaction, inter alia, decreases an amount of discretionary mass that could otherwise be positioned to improve mass properties of the club head, e.g. the magnitudes of moments of inertia about the center of gravity and/or the orientation and magnitude of the principle axes of inertia passing through the center of gravity. Also, by generally removing mass from a sole portion of a club head, e.g. forming a keel-shaped sole portion, a center of gravity height is increased, adversely affecting shot trajectory.

SUMMARY

Certain embodiments of the present invention, in one or more aspects thereof, may advantageously comprise a correlated set of golf clubs in which the golf clubs have one or more sole rails on their respective sole portions. The sole rails are variably arranged among the golf clubs of the correlated set of golf clubs in a manner that controls the amount of interaction between a specific golf club of the correlated set and the ground (or turf). The amount of interaction with the ground is controlled such that the interaction is a desired amount in accordance with a primary goal of the specific golf club. The sole rails also aid in increasing dynamic loft by affecting the center of gravity of the golf club head.

According to various embodiments, a correlated set of golf club heads comprises a first club head that, when oriented in a reference position, includes: a first loft angle, a first heel portion, a first toe portion opposite the first heel portion, a first top portion, and a first sole portion comprising a first sole rail having a first setback length. The set of golf clubs also comprises a second club head that, when oriented in the reference position, includes: a second loft angle greater than the first loft angle, a second heel portion, a second toe portion opposite the second heel portion, a second top portion, and a second sole portion comprising a second sole rail having a second setback length that is different from the first setback length.

According to various embodiments, a correlated set of golf club heads comprises a first club head that, when oriented in a reference position, includes: a first loft angle, a first heel portion, a first toe portion opposite the first heel portion, a first striking face having a first striking face plane and a first forwardmost point, a first top portion, a first sole portion comprising a first rearwardmost point, a first sole length, and a first sole rail having a first sole rail forwardmost point and a first setback length, wherein the first sole length and the first setback length are measured in a first imaginary vertical plane perpendicular to the first striking face plane and passing through the first sole rail forwardmost point, and a first ratio of the first setback length to the first sole length. The set of golf clubs further comprises a second club head that, when oriented in a reference position, includes: a second loft angle greater than the first loft angle, a second heel portion, a second toe portion opposite the second heel portion, a second striking face having a second striking face plane and a second forwardmost point, a second top portion, a second sole portion comprising a second rearwardmost point, a second sole length, and a second sole rail having a second sole rail forwardmost point and a second setback length, wherein the first sole length and the first setback length are measured in a second imaginary vertical plane perpendicular to the second striking face plane and passing through the second sole rail forwardmost point, and a second ratio of the second setback length to the second sole length, wherein the first ratio is less than the second ratio.

According to various embodiments, a correlated set of golf club heads comprises a first club head that, when oriented in a reference position, includes: a first loft angle; a first heel portion; a first toe portion opposite the first heel portion; a first top portion; and a first sole portion comprising a first bottom surface, a first rearward surface, and a first sole rail having a first setback length and a first maximum thickness proximate the first bottom surface. The set of golf clubs further comprises a second club head that, when oriented in a reference position, includes: a second loft angle greater than the first loft angle, a second heel portion, a second toe portion opposite the second heel portion, a second top portion, and a second sole portion comprising a second bottom surface, a second rearward surface, and a second sole rail having a second setback length and a second maximum thickness proximate the second bottom surface, the second maximum thickness being less than the first maximum thickness.

These and other features and advantages of the golf club head according to the invention in its various aspects, as provided by one or more of the various examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

The present invention, in one or more aspects thereof, is illustrated by way of example and not by way of limitation, in the figures of the accompanying drawings, where:

FIG. 1(*a*) is a front elevation view of the golf club head of FIG. 1 showing further detail;

FIG. 1(*b*) is a toe-side elevation view of the golf club head of FIG. 1.

FIG. 1(*c*) is a bottom rear perspective view of the golf club head of FIG. 1;

FIG. 1(*d*) is a toe-side cross-sectional view of the golf club head of FIG. 1 in the plane A-A';

FIG. 1(*e*) is a toe-side cross-sectional view of the golf club head of FIG. 1 in the plane B-B';

For purposes of illustration, these figures are not necessarily drawn to scale. In all the figures, same or similar elements are designated by the same reference numerals.

DETAILED DESCRIPTION

Representative examples of one or more novel and nonobvious aspects and features of golf club heads and correlated sets of golf club heads according to the present invention, disclosed below, are not intended to be limiting in any manner. Furthermore, the various aspects and features of the present invention may be used alone or in a variety of novel and nonobvious combinations and subcombinations with one another.

Some golf clubs, each having club heads, are conventionally sold in correlated sets. For example, a standard set of irons ranges from a 3-iron to a pitching wedge (3i-PW). Such a correlated set of iron-type club heads contains club heads that generally bear similarity in look, structure, feel, and, in some cases, swingweight, yet vary, at generally equal intervals, in loft angle to enable a golfer to flight a golf ball a range of distances while applying a similar golf swing for each club of the set. A 3-iron is intended to hit a ball at a lower trajectory and a further distance than a pitching wedge. However, the 3-iron is typically a more difficult club for a player to use than the pitching wedge, as club length tends to be greater and loft angle tends to be less (resulting in a greater angle of incidence between a striking face plane and a ground plane). The same trend generally occurs throughout the set of correlated clubs as the clubs vary in loft in generally equal increments from a 4-iron to a 9-iron. Similar trends occur throughout a correlated set of wood-type golf clubs, and throughout a correlated set of wedge-type golf clubs.

Figure 1:
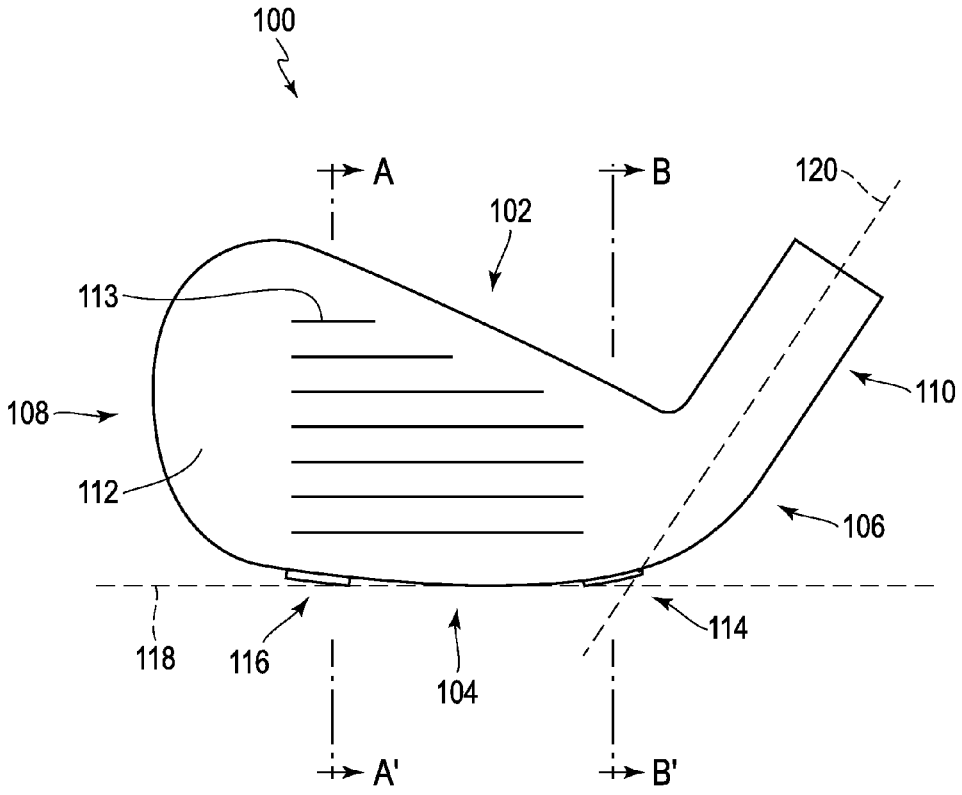
FIG. 1 is a front elevation view of a golf club head having sole rails, according to one or more embodiments.
Figure 1A:
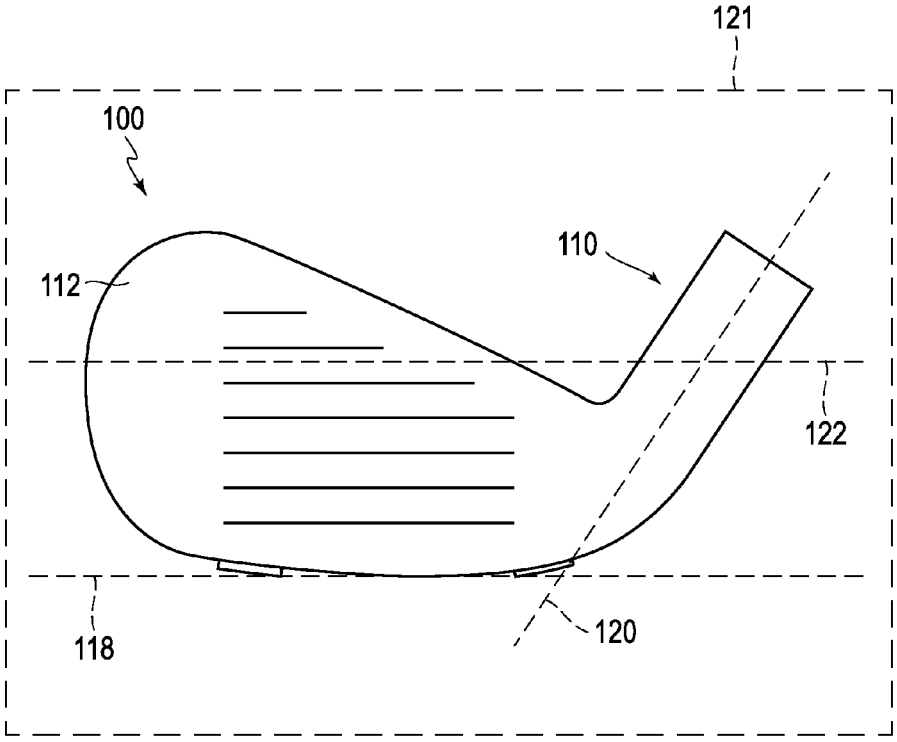
Figure 1B:
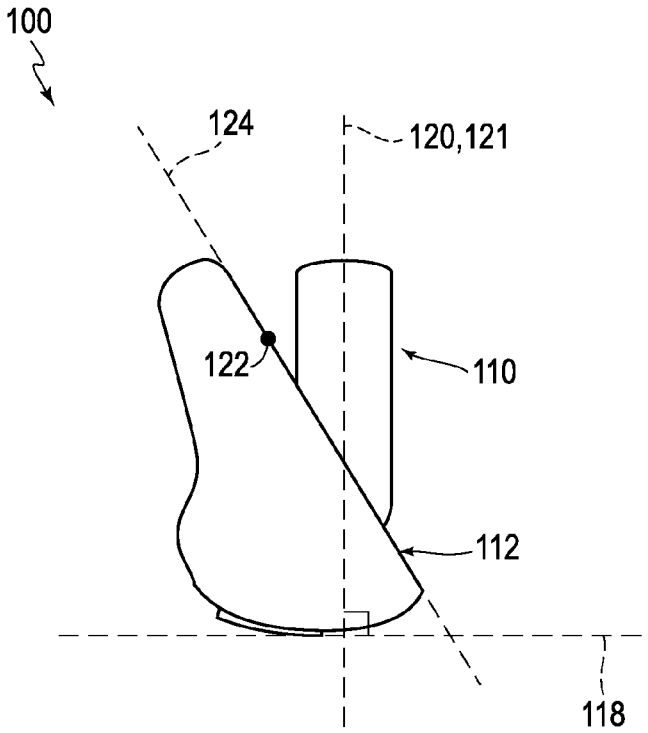
Figure 1C:
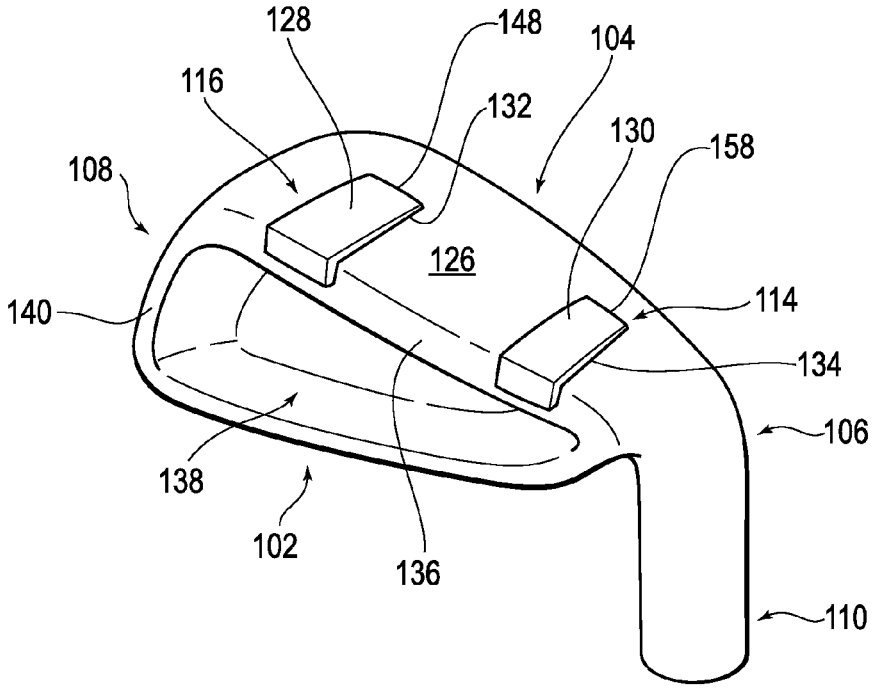
Figure 1D:
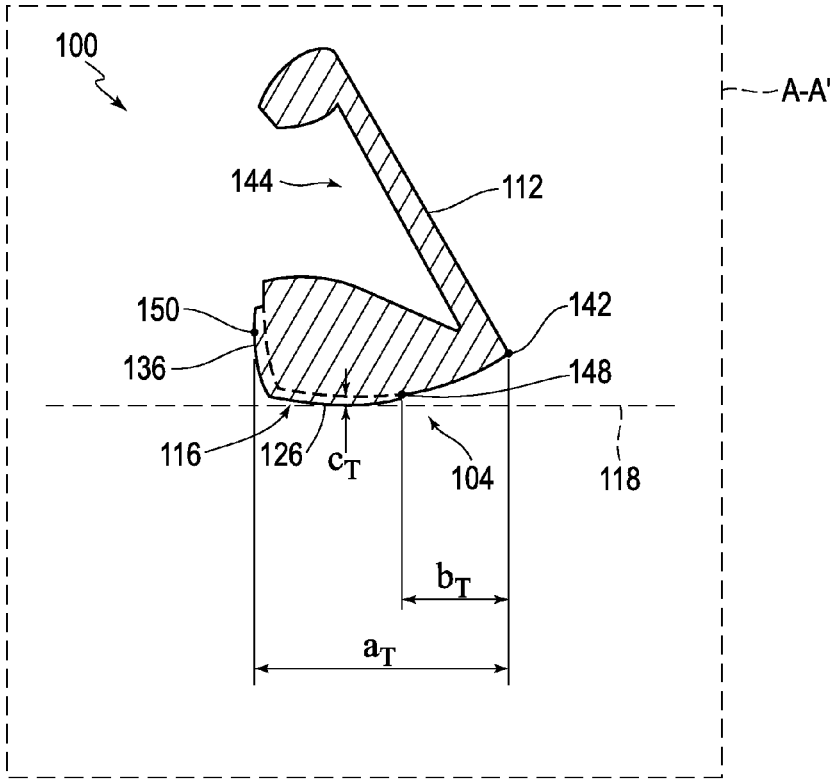
Figure 1E:
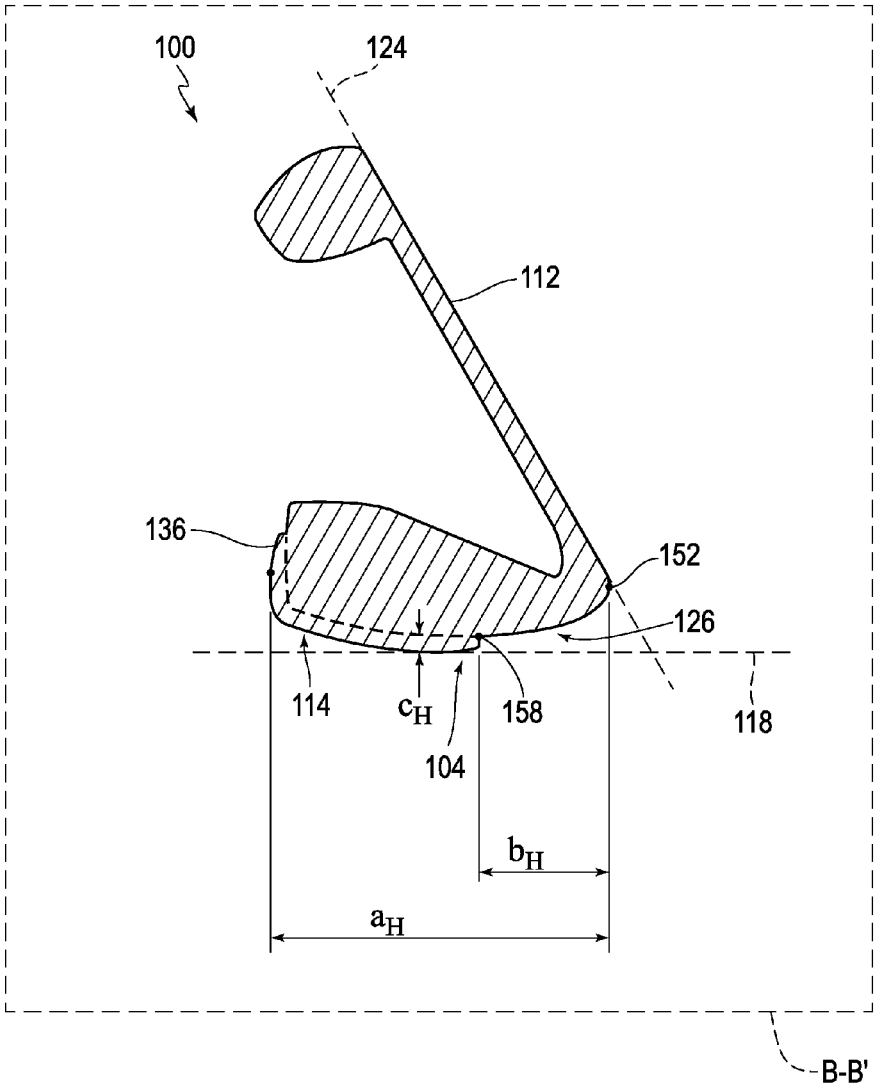
Figure 2A:
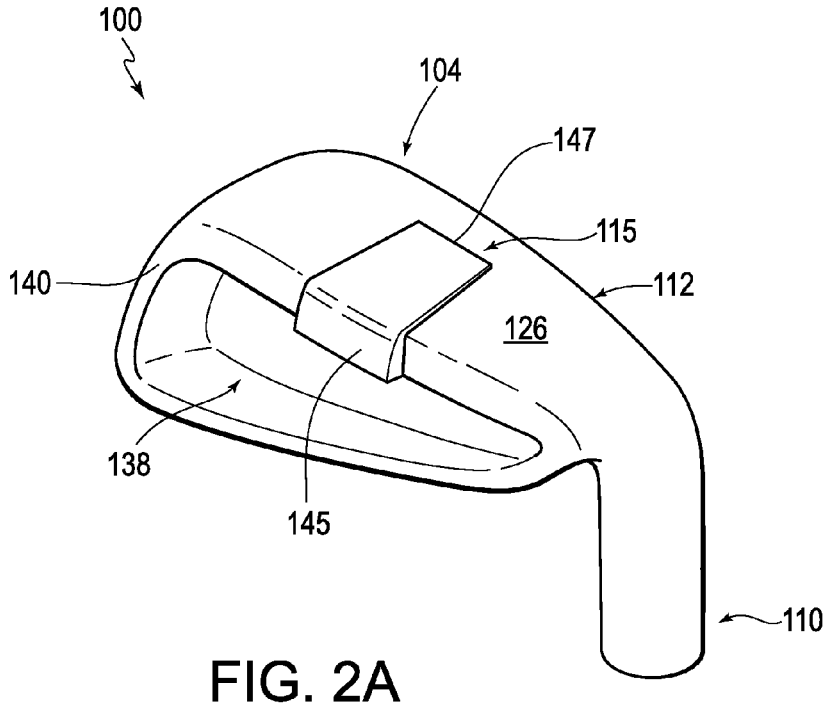
FIGS. 2(*a*)-2(*d*) are each bottom perspective views of alternative configurations of one or more sole rails on a golf club head, according to various embodiments.
Figure 2B:
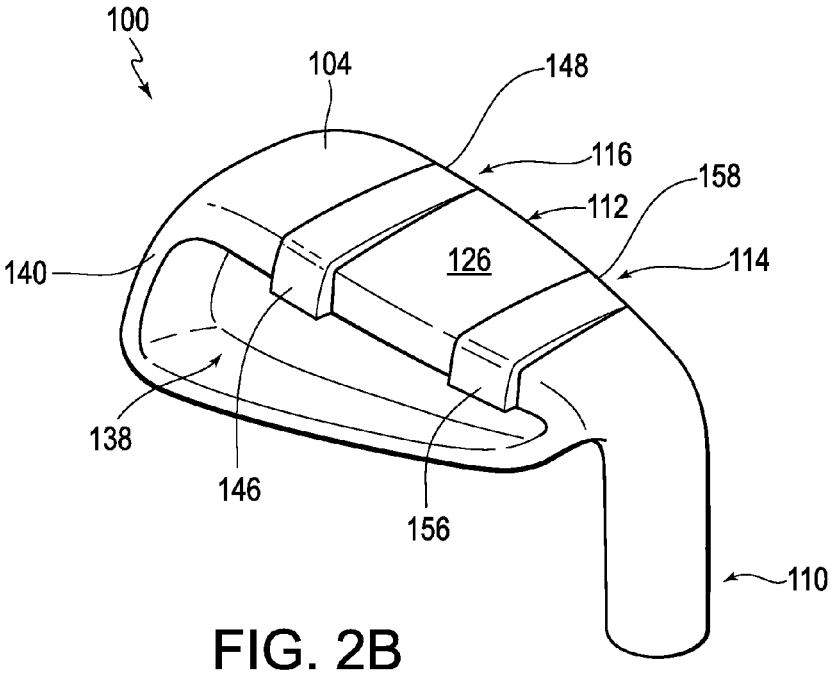
Figure 2C:
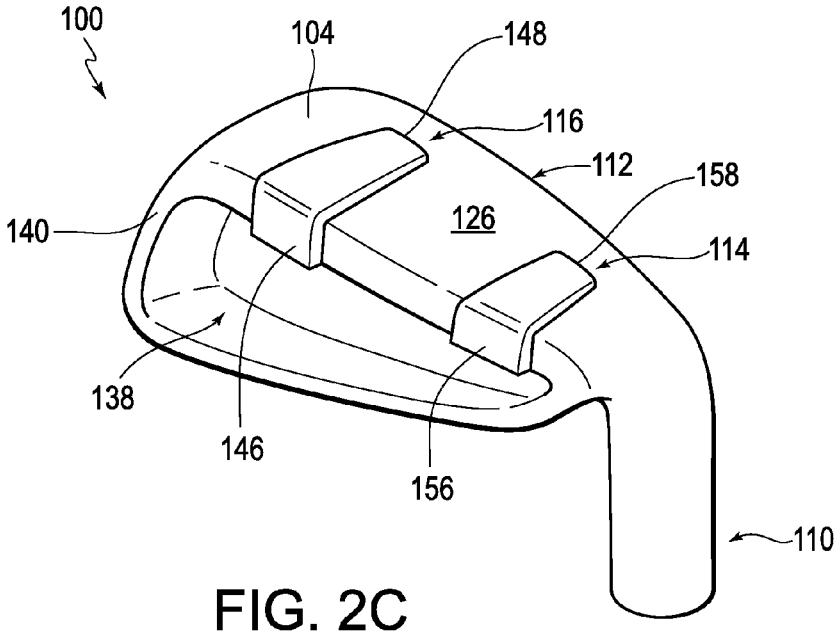
Figure 2D:
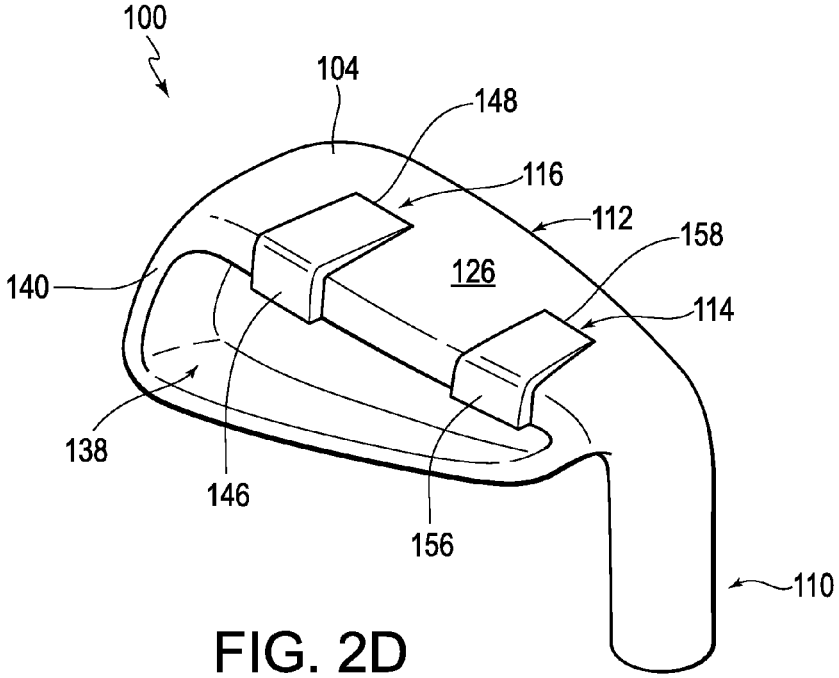
Figure 3A:
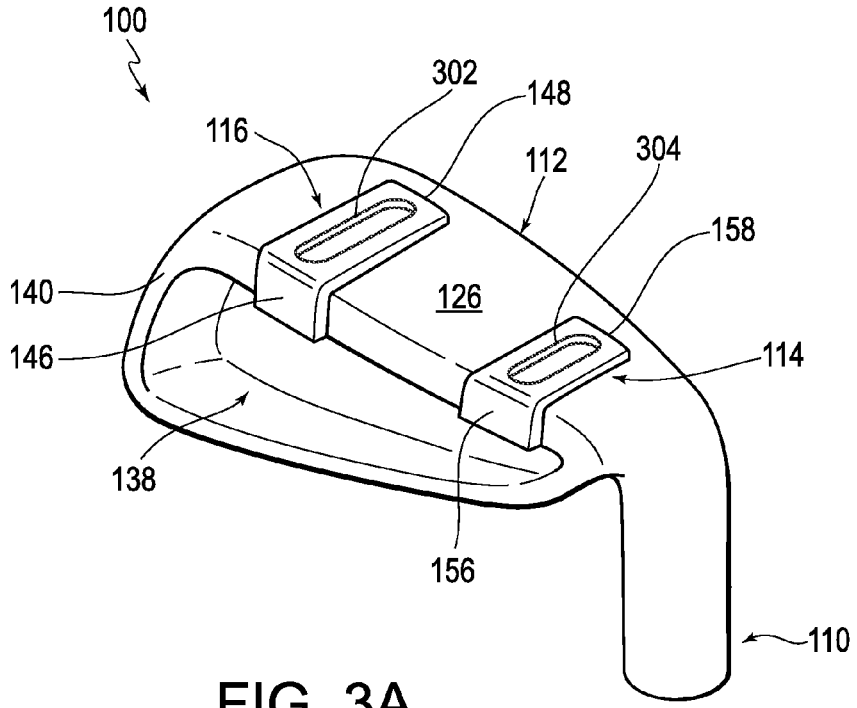
FIGS. 3(*a*)-3(*d*) are each bottom perspective views of alternative configurations of golf club heads having one or more sole rails, according to various embodiments.
Figure 3B:
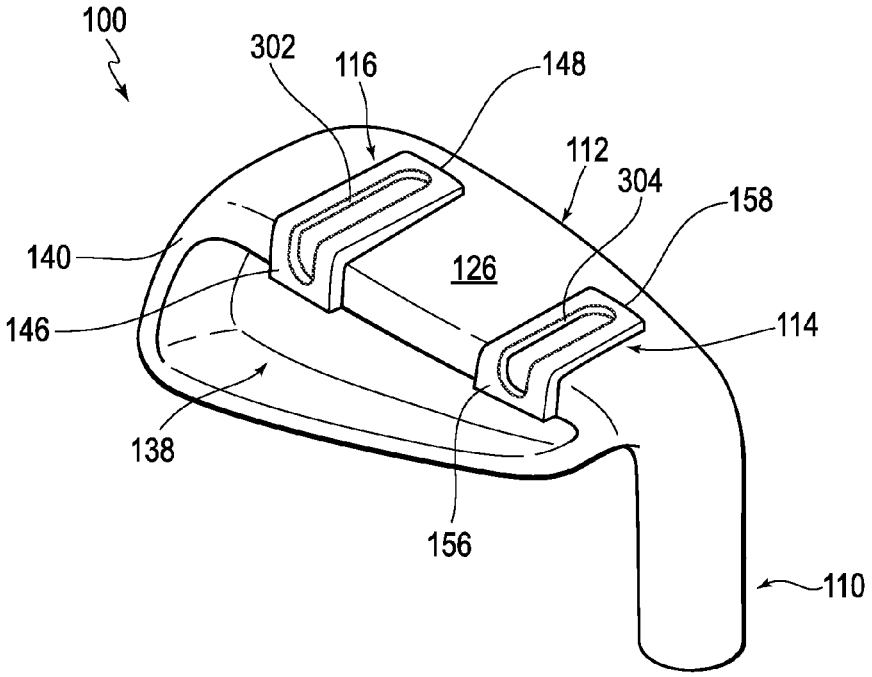
Figure 3C:
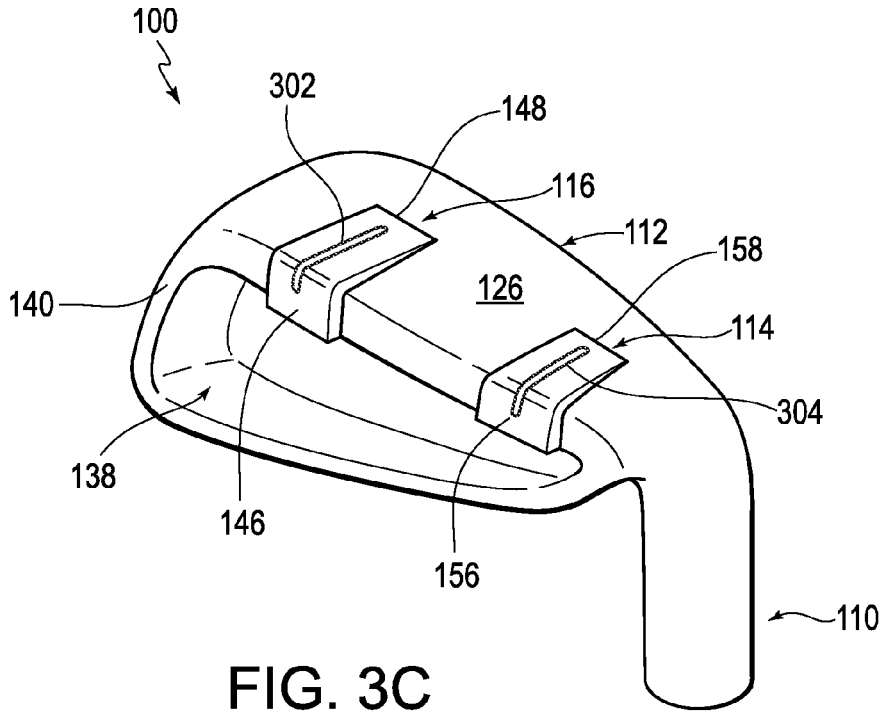
Figure 3D:
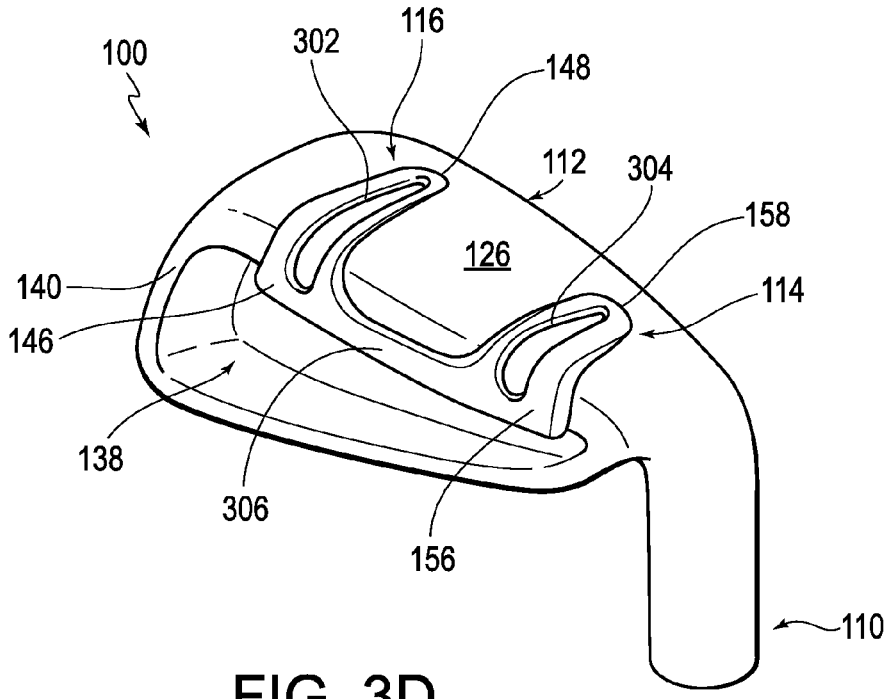
Figure 4A:
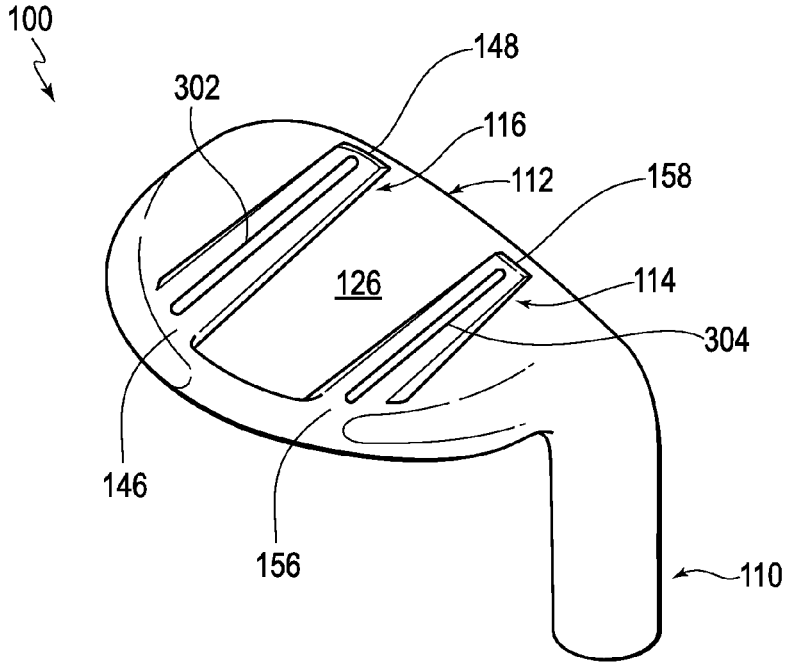
FIGS. 4(*a*)-4(*d*) are each a bottom perspective view of a golf club head of a correlated set of golf club heads, each view showing a configuration of one or more sole rails on a golf club head, according to various embodiments.
Figure 4B:
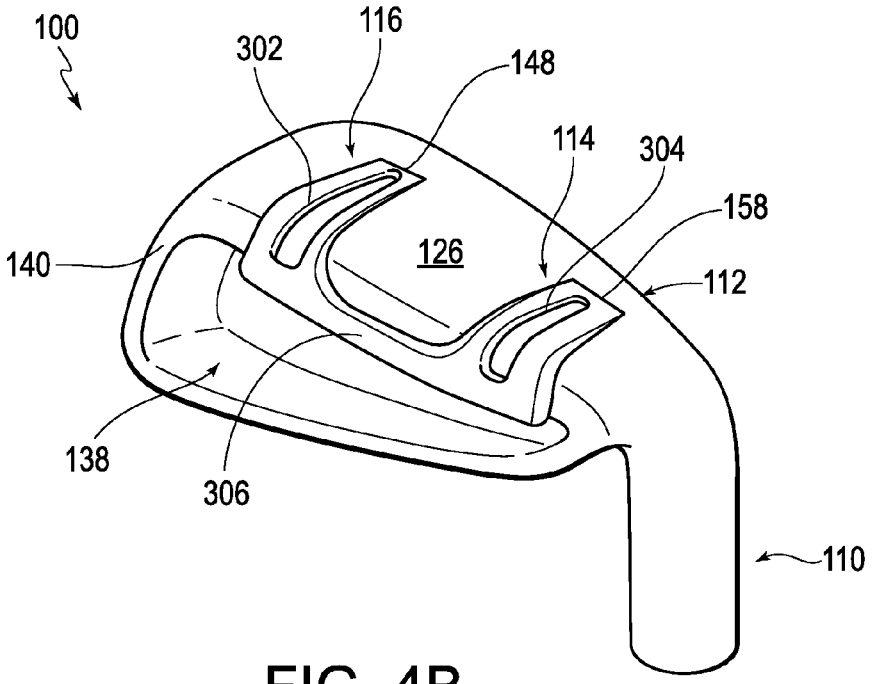
Figure 4C:
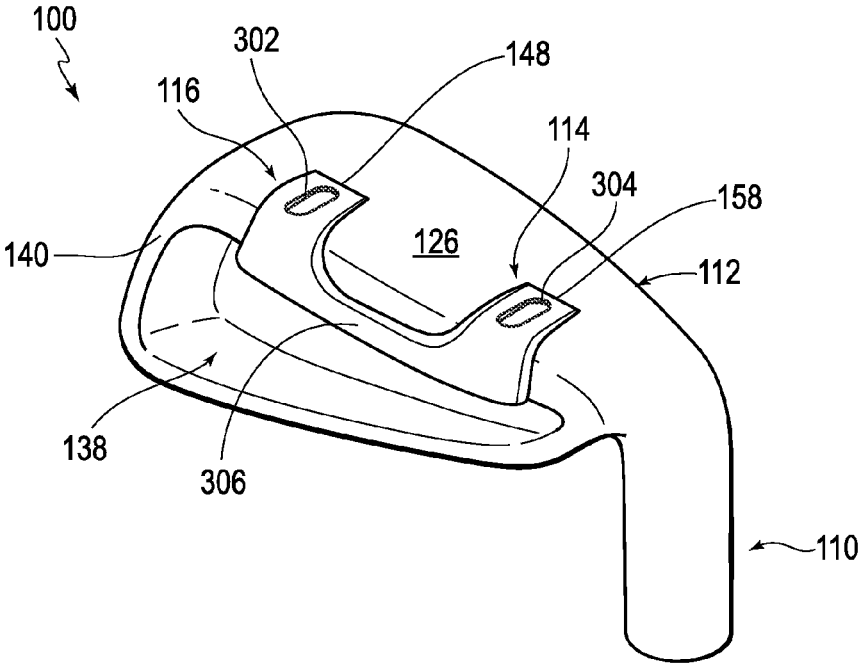
Figure 4D:
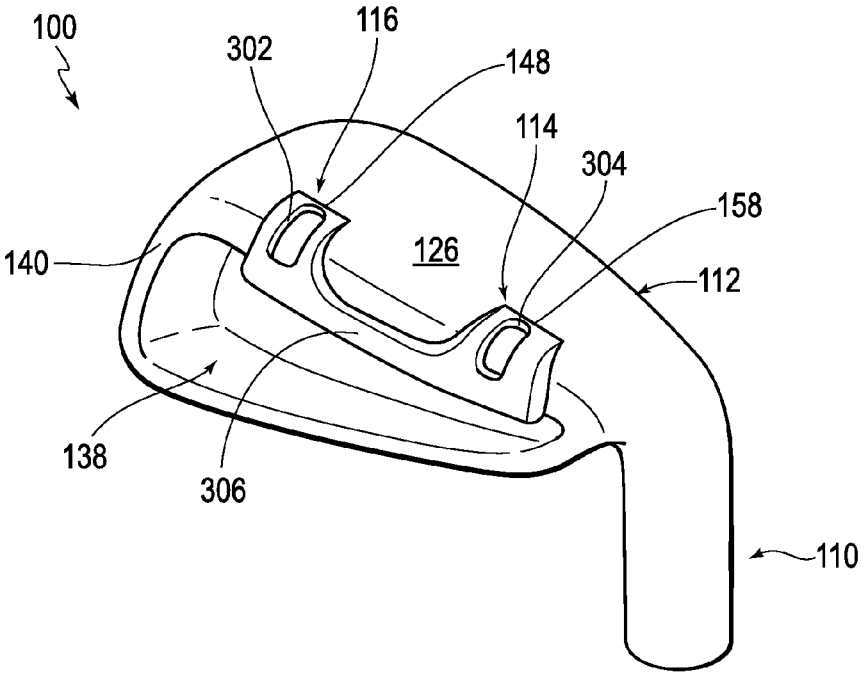

In one or more embodiments, as discussed above, a correlated set of golf clubs includes a plurality of golf clubs, each having a club head secured to a shaft. Referring to FIG. 1, an exemplary golf club head 100 of a correlated set of club heads is shown. The golf club head 100 comprises an iron-type golf club head. It is noted, however, that while the golf club head 100 is illustrated as an iron-type golf club head, the golf club head 100 may be any of, e.g., an iron-type, putter-type, wood-type, hybrid-type, etc. It is further noted that while the golf club head 100 is illustrated as being a right-handed golf club head, any reference to any position on the golf club head 100 may be mirrored and applied to a left-handed golf club head.

In one or more embodiments, the golf club head 100 has a top portion 102, a sole portion 104, a heel portion 106, a toe portion 108, a hosel 110 proximate the heel portion 106, and a striking face 112. The hosel 110 is securable to a shaft (not shown). The striking face 112 may or may not have scorelines 113 that are generally horizontal with respect to the golf club head 100, but may be of any direction, and need not be uniform in width and/or spacing across the striking face 112.

In one or more embodiments, the golf club head 100 has one or more sole rails 114 and 116 protruding from the sole portion 104. The sole rails 114 and 116 are illustrated as being two discrete sole rails 114 and 116, one being a heel-side sole rail 114, proximate the heel portion 106, and the other being a toe-side sole rail 116, proximate the toe portion 108 and distal the heel portion 106. In alternative embodiments, and as discussed below, the sole rails 114 and 116 may be made up of a single sole rail, a single sole rail that has one or more protrusions, e.g. as formed by a central elongated recess, or more than two sole rails. In some embodiments, the number and/or general configuration of sole rails is generally consistent throughout the correlated set. In alternative embodiments, the number and/or configuration of sole rails varies from club head to club head throughout the set. In yet other embodiments, fewer than all club heads of a correlated set comprise sole portions having any sole rails extending outward therefrom.

The golf club head 100 is illustrated in FIGS. 1 through 1(*b*) in a reference position relative to a ground plane 118. The striking face 112 is generally coplanar with a striking face plane 124 (see FIG. 1(*b*)). For example, the striking face 112 may be planar, textured, include scorelines, grooves, or a peripheral groove circling an intended striking area, or have a slight curvature, e.g., a bulge and/or roll radius. The hosel 110 includes a central hosel axis 120.

"Reference position," as used herein, denotes a position of a golf club head, e.g. golf club head 100, relative to the ground plane 118, wherein the hosel axis 120 lies in an imaginary vertical hosel plane 121 such that an imaginary horizontal line 122 lying in the striking face plane 124 is parallel to the hosel plane 121. Unless otherwise indicated, all parameters herein are specified with a club head in the reference position. Also, unless otherwise indicated, vertical and horizontal directions are considered relative to the ground plane, when the club head is in the reference position. FIG. 1 also illustrates cross-sectional planes A-A' and B-B' that are taken perpendicularly to the ground plane 118 (i.e. vertical) and perpendicularly to the striking face plane 124. FIG. 1(*b*) illustrates a toe-side elevation view of the golf club head 100 in the reference position relative to the ground plane 118 such that the hosel axis 120 of the hosel 110 is perpendicular to the ground plane 118.

FIG. 1(*c*) illustrates a bottom heel-side perspective view of the golf club head 100. The golf club head 100 has a top portion 102, a sole portion 104, a heel portion 106, a toe portion 108, and a hosel 110. As discussed above, the sole portion 104 includes the heel-side sole rail 114 and the toe-side sole rail 116. The heel-side sole rail 114 and the toe-side sole rail 116 each protrude from a sole bottom surface 126. The toe-side sole rail 116 includes a bottom surface 128 and a side surface 132 formed between the bottom surface 128 and the bottom surface 126 of the sole portion 104. Junctions between each of the side surfaces 132 and 134 of the heel-side and toe-side sole rails 114 and 116 and each of the bottom surfaces 128 and 130, respectively, and the sole bottom surface 126 are illustrated as being sharp or squared off, but may alternatively be rounded or tapered. For example, in some embodiments, the side surface 132 is radiused at a junction between the side surface 132 and the bottom surface 128 and/or a junction between the side surface 132 and the sole surface 126. In some embodiments, the side surface 134 of the sole rail 114 is configured in like manner. The heel-side sole rail 114 and the toe-side sole rail 116 may be of a same type or look, or may be different from one another. For instance, the heel-side sole rail 114 may have a squared off side surface 134 while the toe sole rail 116 may have a side surface 132 that is tapered or radiused. In other embodiments, the heel-side and toe-side sole rails 114 and 116 have more than one side surface. Each of the side surfaces of the heel and toe sole rails 114 and 116 may be of the same or different geometries.

As illustrated in FIG. 1(*c*), the sole portion 104 has a rearward surface 136 that is located distal the striking face 112. The golf club head 100 also has a cavity 138 that is formed within the golf club head 100 around which a perimeter weighting element 140 is formed. The cavity 138 that forms the perimeter weighting element 140 has an advantageous effect of increasing the forgiveness of the golf club head 100 in the case of an off-center hit. The perimeter weighting element 140, in some cases, also enables the center of gravity of the golf club head 100 to be lower than a golf club head without a cavity. A low center of gravity may increase dynamic loft, such that the golf ball travels at a higher trajectory upon impact. The heel-side sole rail 114 further includes a forwardmost point 158 and the toe-side sole rail 116 further includes a forwardmost point 148.

According to various embodiments, the heel-side and toe-side sole rails 114 and 116 are illustrated as wrapping around the rearward surface 136 of the sole portion 104. Also, the heel-side and toe-side sole rails 114 and 116 affect the center of gravity location. Specifically, in some embodiments, the sole rails 114 and 116 are configured to control the location of the center of gravity, optionally, by lowering the center of gravity of the golf club head 100 relative to a similar club head absent any such sole rails.

According to various embodiments, FIG. 1(*d*) illustrates a cross-sectional view of the club head 100 in the vertical plane A-A' of FIG. 1, with the club head 100 in the reference position. Vertical plane A-A' is perpendicular to the striking face plane 124 and passes through the forwardmost point 148 of the toe-side sole rail 116. The golf club head 100 has a striking face 112 that includes a striking face forwardmost extent 142. The toe-side sole rail 116 includes a first portion proximate the bottom surface 126 of the sole portion 104 and a second portion proximate the rearward surface 136 of the sole portion 104. The rearward surface of 136 the sole portion 104 and the bottom surface 126 of the sole portion 104 meet at a junction that may form a sharp intersection or may be a radiused corner (see e.g. FIG. 1(*c*)). As shown, the combined sole portion-sole rail structure includes a rearwardmost point 150.

According to various embodiments, in the plane A-A', the sole portion 104 has a sole length being the horizontal distance between the forwardmost point 142 of the striking face 142 and the rearwardmost point 150 of the combined sole portion-sole rail structure. The sole length is illustrated as dimension $a_T$. A different sole length may be measured in any other specified vertical plane that passes through the striking face 112 and a portion of the sole portion 104, and that is perpendicular to the striking face plane 124.

According to various embodiments, in the plane A-A', the toe-side sole rail 116 is spaced from the forwardmost extent 142 of the striking face. Specifically, the sole rail 116 has a setback length, $b_T$, being the horizontal distance between the forwardmost point 142 of striking face 142 and the forwardmost point 148 of the toe-side sole rail 116, in the plane A-A'.

According to various embodiments, in the plane A-A', the toe-side sole rail 116 further includes a sole rail thickness, $c_T$, being the distance that the sole rail extends outward from the sole portion. In some embodiments, the thickness of the sole rail 116 varies, optionally in the front to rear direction. Specifically, in some embodiments, as will be discussed below, the sole rail 116 tapers forwardly in thickness. However, in alternative embodiments, the thickness of the sole rail 116 tapers rearwardly or generally increases outwardly from a central location that is intermediate the forwardmost point 148 and the rearwardmost point 150. In further embodiments, the thickness of the sole rail 116 is substantially uniform, when viewed in the forward to rearward direction, in the plane A-A'. Also, in this plane, the sole rail 116 includes a maximum thickness $c_T$, being the maximum distance measured between the bottom surface 128 of the sole rail 116 and the general contour of the bottom surface 126 of the sole portion 104.

According to various embodiments, FIG. 1(*e*) illustrates a cross-sectional view of the golf club head 100 in the plane B-B' of FIG. 1. Vertical plane B-B' passes through the striking face 112 and passes through the forwardmost point 158 of the heel-side sole rail 114, perpendicular to the striking face plane 124. The golf club head 100 is shown in the reference position. In this plane, the striking face 112 has a forwardmost point 152. In like manner to the toe-side sole rail 115, the heel-side sole rail 114 includes a first portion proximate the bottom surface 126 of the sole portion 104 and a second portion proximate the rearward surface 136 of the sole portion 104.

In the vertical plane B-B', the sole rail 114 includes a sole length $a_H$ measured in like manner to corresponding sole length $a_T$ in the vertical plane A-A'. The sole length is illustrated as dimension $a_H$. In some embodiments, the sole length $a_H$ has a different value than the sole length $a_T$ discussed above. In alternative embodiments, the sole length $a_H$ is of substantially the same value as the sole length $a_T$ discussed above.

According to various embodiments, in the plane 13-B', the heel-side sole rail 114 has a setback length $b_T$ being the horizontal distance between forwardmost point of striking face 152 and the forwardmost point 158 of the heel-side sole rail 158. In some embodiments, the setback length $b_H$ differs in value from the setback length $b_T$ discussed above. In alternative embodiments, the setback length $b_H$ is of substantially the same value as the setback length $b_T$ discussed above. A difference between the setback lengths may have an effect on the degree with which the golf club head 100 interacts with the turf.

According to various embodiments, in the plane B-B', the heel-side sole rail 114 includes a sole rail thickness $c_H$ that is measured in like manner to the sole rail thickness of the toe-side sole rail 116, discussed with regard to FIG. 1(*d*). In some embodiments, the sole rail thickness $c_H$ is different from the sole rail thickness $c_T$ discussed above. In alternative embodiments, the sole rail thickness $c_H$ is substantially the same as the sole rail thickness $c_T$ discussed above. A difference between the sole rail thicknesses may have an effect on the degree with which the golf club head 100 interacts with the turf.

Turf interaction is a larger consideration for lower lofted golf club heads because, based at least on a higher angle of incidence with the ground plane, such lower lofted club heads are more likely to be impeded and/or deflected by turf. Therefore, in some embodiments, within a correlated set of iron-type club heads, lower lofted golf club heads 100 have more substantial sole rails than higher lofted golf club heads 100.

For example, as loft angle varies within a correlated set of club heads, the amount of desirable "aided" turf interaction varies. Wedges, which are conventionally of a higher loft than a 3-iron, for example, are intended to have significant turf interaction, and are specifically designed to cut through thick roughs, dig into the turf to impart spin on a golf ball, and/or get to ball airborne at a high trajectory with relative ease. Lower lofted golf club heads, however, are typically more difficult to hit, because, while they generally have striking faces having less face area than higher lofted clubs, they will often get tangled with the turf in thick roughs (or even on the fairway). Also, shots using lower-lofted clubs are less likely to achieve their intended dynamic loft. Players will often for fear of too much turf interaction, pick a golf shot clean, or "skull" the shot such that the turf is not even touched.

Accordingly, the presence of the sole rails 114, 116 enables the golf club head 100 to control the amount of turf interaction between the golf club head 100 and the turf, as well as lower the center of gravity of the golf club head 100. For example, for a lower lofted golf club head 100, the sole rail length may be greater than a higher lofted golf club head 100 of the correlated set of golf club heads 100, which in turn, provides for a more substantial sole rail. The more substantial sole rail results in greater control of turf interaction. For example, the generally rearward-extending sole rails provide resistance against twisting of the club head during a shot, increasing the likelihood that the club head is in the correct orientation at impact with a golf ball. Also, because the sole rails contact, and interact with, the turf, a leading edge of the striking face is less likely to significantly engage with the turf, reducing the likelihood of forward rotation of the club head during a golf swing. These benefits result in a greater probability of an accurate shot, both in terms of lateral dispersion and distance dispersion. While the more substantial sole rail increases the amount of turf interaction, the more substantial sole rail also reduces the risk of "skulling" the golf shot, while reducing the tangling the golf club head 100 experiences with the turf. This is accomplished by lowering the center of gravity of the golf club head 100. The sole rails cause the golf club head to slice through the turf with relative ease, while helping the golf club head have a "correct" amount of interaction with the turf.

The amount of turf interaction is also affected by the overall thickness of the sole rail. The thickness of the sole rail, as discussed above, causes more turf interaction and also lowers the center of gravity of the golf club head as the setback length increases throughout the set of correlated golf club heads 100. It may be desirable to reduce the overall thickness of the sole rails 114, 116 in the application of the sole rails 114, 116 to control the amount of turf interaction of a wedge, for example, or a higher lofted golf club head 100 in relation to lower lofted golf club heads of the correlated set of golf club heads 100.

The amount of turf interaction is also affected by the setback length of the sole rail. The setback length of the sole rail causes more turf interaction when the setback length is at a minimum. It may be desirable to increase the overall setback length of the sole rails 114, 116 in the application of the sole rails 114, 116 to control the amount of turf interaction of a wedge, for example, or a higher lofted golf club head 100 to decrease the effect that the sole rails 114, 116 have on the turf interaction in relation to lower lofted golf club heads of the correlated set of golf club heads 100.

While the various dimensions of the sole rails 114, 116 have an effect on the amount of turf interaction that the golf club head 100 has with the ground, the geometries of the sole rails 114, 116 also have an effect on the amount of turf interaction. For example, the forwardmost extent of any of the sole rails 114, 116 may be blunt, rounded, or tapered so as to gradually decrease in thickness. A tapered thickness would reduce the amount of turf interaction, while a blunt-shaped leading edge would cause an increase in turf interaction. In certain embodiments, the amount of drag experienced by the golf club head 100 may be altered by the geometry of the forward and rearward most extents of the sole rails 114, 116.

The overall geometries of the sole rails may be customized and varied to correspond to a particular player's preferences to cause, for example, an increase or decrease in turf interaction between the heel and toe of the golf club head 100. For example, and increase in turf interaction in the heel of the golf club head 100 may cause the golf club head 100 to close at impact thereby imparting a draw bias caused by the significance of the heel sole rail 114. The opposite may be true for changing the significance of the toe sole rail, which may be altered to cause, for example, more turf interaction in the toe, or to affect the weighting of the golf club head 100, which would impart a fade bias.

Table 1-1 below illustrates an example of how the dimensions of the sole rails 114, 116 may vary in relation to one another among a set of correlated golf clubs. The example set of correlated golf clubs is given as being a 3-iron, 6-iron, 7-iron, 9-iron, sand wedge (SW) and dual wedge (DW). The discussed correlated set of golf clubs may be any set of golf clubs having at least two golf club heads 100 that vary in degree of loft by no more than 12 degrees from one another. Conventionally, correlated sets of golf clubs vary in degree by about 3-4 degrees from one golf club head to the next progressive club head in the correlated set of golf clubs of, for example, 3-pitching wedge (PW).

Table 1-1 also illustrates a heel and toe sole rail length, $d_H$, $d_T$ that is the difference between the heel sole length $a_H$ or the toe sole length $a_T$ and their respective setback lengths, $b_H$, $b_T$.

$c_H$=heel sole rail thickness
$d_H$=heel sole rail length
$a_H$=heel sole length
$b_H$=heel sole rail setback length
$c_T$=toe sole rail thickness
$d_T$=toe sole rail length
$a_T$=toe sole length
$b_T$=toe sole rail setback length

TABLE 1-1

Correlated Set of Golf Club Heads - Dimensions in mm

| Iron no | loft | $c_H$ | $d_H$ | $a_H$ | $b_H$ | $b_H/a_H$ | $c_T$ | $d_T$ | $a_T$ | $b_T$ | $b_T/a_T$ |
|---|---|---|---|---|---|---|---|---|---|---|---|
| 3 | 19 | 1.87 | 50.4 | 51.13 | 0.73 | 0.01 | 1.57 | 57.3 | 58.7 | 1.4 | 0.02 |
| 6 | 27 | 0.71 | 17.68 | 26.28 | 8.6 | 0.33 | 0.95 | 24.96 | 32.43 | 7.47 | 0.23 |
| 7 | 31 | 0.68 | 15.62 | 24.96 | 9.34 | 0.37 | 1.08 | 21.48 | 28.46 | 6.98 | 0.25 |
| 9 | 39 | 0.67 | 16.76 | 26.22 | 9.46 | 0.36 | 0.99 | 21.81 | 32.7 | 10.89 | 0.33 |
| SW | | 0 | 11.99 | 27.14 | 15.15 | 0.56 | 0 | 15.02 | 35.54 | 20.52 | 0.58 |
| DW | | 0 | 9.94 | 27.36 | 17.42 | 0.64 | 0 | 13.88 | 34.64 | 20.76 | 0.60 |

Referring to FIGS. 2(*a*)-4(*d*), example embodiments of various arrangements of sole rails on a golf club head 100 are provided. The number, or characteristics, of the sole rail(s) may vary between one or more numbered golf club heads of a correlated set, and may be uniform or different in the variation from one another throughout the correlated set of golf club heads 100.

In FIG. 2(*a*), a golf club head 100 is illustrated as having a hosel 110 and a striking face 112. The golf club head 100 has a sole portion 104 including a bottom surface 126, a cavity 138 and a perimeter weighting element 140. The golf club head 100 also has a single sole rail 115 that has a forwardmost extent 147 and a rearwardmost extent 145. The sole rail 115 is illustrated as being centered on the sole surface 126, but may be positioned anywhere on the sole surface 126. The sole rail 115 may have an advantageous effect based on a player preference if positioned closer to the heel than the toe for a particular golf club head 100, and may vary among different golf club heads 100 of a correlated set of golf club heads. The positioning of the sole rail 115 causes a change in the weighting of the golf club head 100. The variation in positioning may be between any number of golf club heads 100 of the correlated set of golf club heads 100, and may cause a change in the moment of inertia of the golf club head 100.

The single sole rail 115 is also illustrated as having a tapered thickness and terminates at the forwardmost extent 147 of the sole rail 115. The forwardmost extent 147 of the sole rail 115 is illustrated as being at a position on the sole surface 126 that does not terminate at the striking face 112. The forwardmost extent of the sole rail 115 may be at any position on the sole surface of the golf club head 100 from the striking face 112 to the rear surface of the sole portion.

The tapered end of the sole rail 115 may vary in degree, for example one tapered end of the golf club head 100 may be steeper than another tapered end of the sole rail 115 on another golf club head 100 of the correlated set of golf club heads 100. For instance, if one sole rail 115 has a thickness greater than another sole rail 115 on another golf club head 100, and the sole rails 115 of each of the golf club heads 100 have a same sole length, then the degree of the taper of the thicker sole rail 115 will be greater than the degree of taper of the other sole rail 115.

According to various embodiments, as discussed above, the taper may or may not be present to affect the degree of turf interaction that the golf club head 100 experiences.

FIG. 2(*b*) illustrates a golf club head 100 having a hosel 110, a striking face 112, a heel-side sole rail 114 and a toe-side sole rail 116 present on the sole surface 126. The golf club head 100 also has a cavity 138 and a perimeter weighting element 140. The heel-side and toe-side sole rails 114, 116 have rearwardmost extents 156 and 146, respectively, and forwardmost extents 158 and 148, respectively. In this embodiment, the sole rails 114 and 116 have different sole lengths because the heel portion of the golf club head 100 may be naturally narrower than the toe portion of the golf club head 100. The forwardmost extents 148 and 158 of the sole rails 114, 116 are positioned at the striking face 112. The rearwardmost extents 146, 156 wrap around the perimeter weighting element 140 of the golf club head 100. In this embodiment, the thickness of the sole rails 114, 116 are tapered so as to generally decrease from the rearwardmost extent to the forwardmost extent.

FIG. 2(*c*) illustrates a golf club head 100 having a hosel 110, a striking face 112, a heel-side sole rail 114 and a toe-side sole rail 116 present on the sole surface 126. The golf club head 100 also has a cavity 138 and a perimeter weighting element 140. The heel and toe sole rails 114, 116 have rearwardmost extents 156 and 146, respectively, and forwardmost extents 158 and 148, respectively. In this embodiment, the sole rails 114 and 116 have different sole lengths at least in part because of a player preference, but also because the heel portion of the golf club head 100 is narrower than the toe portion of the golf club head 100. The forwardmost extents 148 and 158 of the sole rails 114, 116 are positioned at the striking face 112. The rearwardmost extents 146, 156 wrap around the perimeter weighting element 140 of the golf club head 100. In this embodiment, the thickness of the sole rails 114, 116 are kept at a uniform thickness such that the forwardmost extent of the sole rails 158, 148 are either blunt or rounded, and the thickness does not generally decrease from the rearwardmost extent to the forwardmost extent.

FIG. 2(*d*) illustrates a golf club head 100 having a hosel 110, a striking face 112, a heel-side sole rail 114 and a toe-side sole rail 116 present on the sole surface 126. The golf club head 100 also has a cavity 138 and a perimeter weighting element 140. The heel and toe sole rails 114, 116 have rearward most extents 156 and 146, respectively, and forward most extents 158 and 148, respectively. In this embodiment, the sole rails 114 and 116 have different sole lengths at least in part because of a player preference, but also because the heel portion of the golf club head 100 is narrower than the toe portion of the golf club head 100. The forwardmost extents 148 and 158 of the sole rails 114, 116 are positioned at the striking face 112. The rearwardmost extents 146, 156 wrap around the perimeter weighting element 140 of the golf club head 100. In this embodiment, the thickness of the sole rails 114, 116 are tapered so as to generally decrease in thickness from the rearwardmost extent to the forwardmost extent.

FIG. 3(*a*) illustrates a golf club head 100 having a hosel 110, a striking face 112, a heel-side sole rail 114 and a toe-side sole rail 116 present on the sole surface 126. The golf club head 100 also has a cavity 138 and a perimeter weighting element 140. The heel-side and toe-side sole rails 114, 116 have rearwardmost extents 156 and 146, respectively, and forwardmost extents 158 and 148, respectively. In this embodiment, the sole rails 114 and 116 have different sole lengths at least in part because of a player preference, but also because the heel portion of the golf club head 100 is narrower than the toe portion of the golf club head 100. The forwardmost extents 148 and 158 of the sole rails 114, 116 are positioned at the striking face 112. The rearwardmost extents 146, 156 wrap around the perimeter weighting element 140 of the golf club head 100. In this embodiment, the thickness of the sole rails 114, 116 are kept at a uniform thickness such that the forwardmost extent of the sole rails 158, 148 are either blunt or rounded, and the thickness does not generally decrease in thickness from the rearwardmost extent to the forwardmost extent.

The golf club head 100 illustrated in FIG. 3(*a*) also has toe and heel sole rail grooves 302 and 304. In this embodiment, the sole rail grooves 302 and 304 are present only in a lower portion of the sole rails 116 and 114, and do not wrap around the perimeter weighting element 140 of the golf club head 100. The presence of the sole rail grooves has an effect of enabling more of the weight added to the golf club head 100 by the sole rails 114 and 116 to be moved toward the rear of the golf club head 100, which has an effect on the moment of inertia of the golf club head, as well as its center of gravity. The presence of the sole rail grooves 302, 304, may also have an effect on the amount of turf interaction experienced by the golf club head 100. The sole rail grooves 302 and 304 reduce the amount of surface area of the sole rails 114, 116 that comes in contact with the turf, thereby reducing an amount of drag that may be caused by any turf interaction. Such a reduction in drag may have an advantageous effect on any reduction in club head speed that may occur on account of the turf interaction. Because the sole rail grooves 302, 304 terminate on the sole portion of the sole rails 114, 116, there is an element of drag that is controlled by rearward portion of the sole rail groove, but as illustrated in FIG. 3(*b*), the termination of the sole rail groove may be extended to reduce drag even further. It is noted that while both sole rails 114 and 116 are illustrated as having their own respective sole rail grooves 302 and 304, it is possible to have a golf club head 100 that has a sole rail groove present in only one of the sole rails 114, 116. An absence of the sole rail groove may be a function of player preference to affect how the sole rails 114 and 116 affect the performance of the golf club head 100 in various conditions. Different golf club heads 100 of a correlated set of golf club heads 100 may have any combination of sole rails with sole rail grooves depending on the particular goals of the golf club heads of the correlated set of golf club heads 100.

FIG. 3(*b*) illustrates a golf club head 100 having a hosel 110, a striking face 112, a heel sole rail 114 and a toe sole rail 116 present on the sole surface 126. The golf club head 100 also has a cavity 138 and a perimeter weighting element 140. The heel-side and toe-side sole rails 114, 116 have rearward most extents 156 and 146, respectively, and forward most extents 158 and 148, respectively. In this embodiment, the sole rails 114 and 116 have different sole lengths at least in part because of a player preference, but also because the heel portion of the golf club head 100 is narrower than the toe portion of the golf club head 100. The forwardmost extents 148 and 158 of the sole rails 114, 116 are positioned at the striking face 112. The rearward most extents 146, 156 wrap around the perimeter weighting element 140 of the golf club head 100. In this embodiment, the thickness of the sole rails 114, 116 are kept at a uniform thickness such that the forwardmost extent of the sole rails 158, 148 are either blunt or rounded, and the thickness does not generally decrease in thickness from the rearwardmost extent to the forwardmost extent.

The golf club head 100 illustrated in FIG. 3(*b*) also has toe-side and heel-side sole rail grooves 302 and 304. In this embodiment, the sole rail grooves 302 and 304 are present in a lower portion of the sole rails 116 and 114, and wrap around the perimeter weighting element 140 of the golf club head 100. The presence of the sole rail grooves has an effect of enabling more of the weight added to the golf club head 100 by the sole rails 114 and 116 to be moved toward the rear of the golf club head 100, which has an effect on the moment of inertia of the golf club head, as well as its center of gravity. The presence of the sole rail grooves 302, 304, may also have an effect on the amount of turf interaction experienced by the golf club head 100. The sole rail grooves 302 and 304 reduce the amount of surface area of the sole rails 114, 116 that comes in contact with the turf, thereby reducing an amount of drag that may be caused by any turf interaction. Such a reduction in drag may have an advantageous effect on any reduction in club head speed that may occur on account of the turf interaction. Because the sole rail grooves 302 and 304 terminate at a position that is on the perimeter weighting element, any drag induced by the sole rail grooves' 302, 304 termination on the sole surface 126 is eliminated.

It is noted that while both sole rails 114 and 116 are illustrated as having their own respective sole rail grooves 302 and 304, it is possible to have a golf club head 100 that has a sole rail groove present in only one of the sole rails 114, 116. An absence of the sole rail groove may be a function of player preference to affect how the sole rails 114 and 116 impact the performance of the golf club head 100 in various conditions. Different golf club heads 100 of a correlated set of golf club heads 100 may have any combination of sole rails with sole rail grooves depending on the particular goals of the golf club heads of the correlated set of golf club heads 100.

FIG. 3(*c*) illustrates a golf club head 100 having a hosel 110, a striking face 112, a heel sole rail 114 and a toe sole rail 116 present on the sole surface 126. The golf club head 100 also has a cavity 138 and a perimeter weighting element 140. The heel and toe sole rails 114, 116 have rearward most extents 156 and 146, respectively, and forward most extents 158 and 148, respectively. In this embodiment, the sole rails 114 and 116 have different sole lengths at least in part because of a player preference, but also because the heel portion of the golf club head 100 is narrower than the toe portion of the golf club head 100. The forwardmost extents 148 and 158 of the sole rails 114, 116 are positioned at the striking face 112. The rearward most extents 146, 156 wrap around the perimeter weighting element 140 of the golf club head 100. In this embodiment, the thickness of the sole rails 114, 116 are tapered from the rearwardmost portion of the sole rails 146, 156 toward the striking face 112 such that the forwardmost extent of the sole rails 158, 148 are gradually decreased to appear to be flush with the sole surface 126. Accordingly, the thickness generally decreases in thickness from the rearwardmost extent to the forwardmost extent. This tapering has an advantageous effect of reducing the amount of drag caused by the sole rails 114, 116 in their interaction with the turf.

The golf club head 100 illustrated in FIG. 3(*c*) also has toe and heel sole rail grooves 302 and 304. In this embodiment, the sole rail grooves 302 and 304 are present in a lower portion of the sole rails 116 and 114, and wrap around the perimeter weighting element 140 of the golf club head 100. The presence of the sole rail grooves has an effect of enabling more of the weight added to the golf club head 100 by the sole rails 114 and 116 to be moved toward the rear of the golf club head 100, which has an effect on the moment of inertia of the golf club head, as well as its center of gravity. The presence of the sole rail grooves 302, 304, may also have an effect on the amount of turf interaction experienced by the golf club head 100. The sole rail grooves 302 and 304 reduce the amount of surface area of the sole rails 114, 116 that comes in contact with the turf, thereby reducing an amount of drag that may be caused by any turf interaction. Such a reduction in drag may have an advantageous effect on any reduction in club head speed that may occur on account of the turf interaction. Because the sole rail grooves 302 and 304 terminate at a position that is on the perimeter weighting element, any drag induced by the sole rail grooves' 302, 304 termination on the sole surface 126 is eliminated.

The sole grooves 302, 304 that are illustrated, are illustrated as being narrower than the sole grooves 302, 304 illustrated in FIGS. 3(*a*) and 3 (*b*) discussed above. This is an example of how adjusting the sole grooves is possible between golf club heads 100 of a correlated set of golf clubs. As discussed above, the size of the sole groove has an effect on the amount of drag that is imparted by the turf on the golf club head 100 during a golf shot. It may be advantageous for a certain club of a correlated set to have a wider groove than another golf club head 100 of a correlated set to attain certain shot goals such as increasing or decreasing the amount of desired turf interaction.

It is noted that while both sole rails 114 and 116 are illustrated as having their own respective sole rail grooves 302 and 304, it is possible to have a golf club head 100 that has a sole rail groove present in only one of the sole rails 114, 116. An absence of the sole rail groove may be a function of player preference to affect how the sole rails 114 and 116 affect the performance of the golf club head 100 in various conditions. Different golf club heads 100 of a correlated set of golf club heads 100 may have any combination of sole rails with sole rail grooves depending on the particular goals of the golf club heads of the correlated set of golf club heads 100.

FIG. 3(*d*) illustrates a golf club head 100 having a hosel 110, a striking face 112, a heel sole rail 114 and a toe sole rail 116 present on the sole surface 126. The golf club head 100 also has a cavity 138 and a perimeter weighting element 140. The heel and toe sole rails 114, 116 have rearward most extents 156 and 146, respectively, and forward most extents 158 and 148, respectively. In this embodiment, the sole rails 114 and 116 have different sole lengths at least in part because of a player preference, but also because the heel portion of the golf club head 100 is narrower than the toe portion of the golf club head 100. The forwardmost extents 148 and 158 of the sole rails 114, 116 are positioned at the striking face 112. The rearward most extents 146, 156 wrap around the perimeter weighting element 140 of the golf club head 100. In this embodiment, the thickness of the sole rails 114, 116 are tapered from the rearwardmost portion of the sole rails 146, 156 toward the striking face 112 such that the forwardmost extent of the sole rails 158, 148 are gradually decreased to appear to be flush with the sole surface 126. Accordingly, the thickness generally decreases in thickness from the rearwardmost extent to the forwardmost extent. This tapering has an advantageous effect of reducing the amount of drag caused by the sole rails 114, 116 in their interaction with the turf.

The golf club head 100 illustrated in FIG. 3(*d*) also has toe and heel sole rail grooves 302 and 304. In this embodiment, the sole rail grooves 302 and 304 are present in a lower portion of the sole rails 116 and 114, and wrap around the perimeter weighting element 140 of the golf club head 100. The presence of the sole rail grooves has an effect of enabling more of the weight added to the golf club head 100 by the sole rails 114 and 116 to be moved toward the rear of the golf club head 100, which has an effect on the moment of inertia of the golf club head, as well as its center of gravity. The presence of the sole rail grooves 302, 304, may also have an effect on the amount of turf interaction experienced by the golf club head 100. The sole rail grooves 302 and 304 reduce the amount of surface area of the sole rails 114, 116 that comes in contact with the turf, thereby reducing an amount of drag that may be caused by any turf interaction. Such a reduction in drag may have an advantageous effect on any reduction in club head speed that may occur on account of the turf interaction. Because the sole rail grooves 302 and 304 terminate at a position that is on the perimeter weighting element, any drag induced by the sole rail grooves' 302, 304 termination on the sole surface 126 is eliminated.

The sole grooves 302, 304 that are illustrated, are illustrated as having a forwardmost portion 148, 158 that is tapered and is angled or rounded such that drag caused by the presence of a sole rail 114, 116 is further reduced from a blunt sole rail.

The golf club head 100 further has a rail connector 306 that is positioned on the sole surface 126 of the golf club head 100 and/or the perimeter weighting element 140. The rail connector 306 connects the heel sole rail 114 to the toe sole rail 116. The rail connector 306 allows for weight to be added to the golf club head 100 such that the weight is further behind the cavity 138, and therefore lowers the center of gravity of the golf club head 100.

It is noted that while both sole rails 114 and 116 are illustrated as having their own respective sole rail grooves 302 and 304, it is possible to have a golf club head 100 that has a sole rail groove present in only one of the sole rails 114, 116. An absence of the sole rail groove may be a function of player preference to affect how the sole rails 114 and 116 affect the performance of the golf club head 100 in various conditions. Different golf club heads 100 of a correlated set of golf club heads 100 may have any combination of sole rails with sole rail grooves and rail connectors depending on the particular goals of the golf club heads of the correlated set of golf club heads 100.

FIGS. 4(*a*)-4(*c*) illustrate an example correlated set of golf club heads 100, according to one embodiment. The examples illustrated in FIGS. 4(*a*)-4(*d*) may also be considered individual examples of various embodiments of golf club heads 100 having sole rails and may be combined with any other of the example embodiments discussed above to form a correlated set of golf club heads.

FIG. 4(*a*) illustrates a golf club head 100 having a hosel 110, a striking face 112, a heel sole rail 114 and a toe sole rail 116 present on the sole surface 126. The golf club head 100, unlike other examples, does not have an open cavity. Rather, the golf club head 100 is a wood-type or hybrid-type golf club head that may be solid or hollow. The heel and toe sole rails 114, 116 have rearward most extents 156 and 146, respectively, and forward most extents 158 and 148, respectively. In this embodiment, the sole rails 114 and 116 have different sole lengths at least in part because of a player preference, but also because the heel portion of the golf club head 100 is narrower than the toe portion of the golf club head 100. The forwardmost extents 148 and 158 of the sole rails 114, 116 are positioned at the striking face 112. The rearward most extents 146, 156 terminate at an end portion of the sole surface 126 of the golf club head 100. In this embodiment, the thickness of the sole rails 114, 116 are tapered from the rearwardmost portion of the sole rails 146, 156 toward the striking face 112 such that the forwardmost extent of the sole rails 158, 148 are gradually decreased to appear to be flush with the sole surface 126. Accordingly, the thickness generally decreases in thickness from the rearwardmost extent to the forwardmost extent. This tapering has an advantageous effect of reducing the amount of drag caused by the sole rails 114, 116 in their interaction with the turf.

The golf club head 100 illustrated in FIG. 4(*a*) also has toe and heel sole rail grooves 302 and 304. In this embodiment, the sole rail grooves 302 and 304 are present in a lower portion of the sole rails 116 and 114, and terminate at a rear portion of the sole surface 126 of the golf club head 100. The presence of the sole rail grooves has an effect of enabling more of the weight added to the golf club head 100 by the sole rails 114 and 116 to be moved toward the rear of the golf club head 100, which has an effect on the moment of inertia of the golf club head, as well as its center of gravity. The presence of the sole rail grooves 302, 304, may also have an effect on the amount of turf interaction experienced by the golf club head 100. The sole rail grooves 302 and 304 reduce the amount of surface area of the sole rails 114, 116 that comes in contact with the turf, thereby reducing an amount of drag that may be caused by any turf interaction. Such a reduction in drag may have an advantageous effect on any reduction in club head speed that may occur on account of the turf interaction. Because the sole rail grooves 302 and 304 terminate at a position other than the sole surface 126, any drag induced by the sole rail grooves' 302, 304 termination on the sole surface 126 is eliminated.

The sole grooves 302, 304 that are illustrated, are illustrated as being narrower than the sole grooves 302, 304 illustrated in FIGS. 3(*a*) and 3 (*b*) discussed above. This is an example of how adjusting the sole grooves is possible between golf club heads 100 of a correlated set of golf clubs.

As discussed above, the size of the sole groove has an effect on the amount of drag that is imparted by the turf on the golf club head 100 during a golf shot. It may be advantageous for a certain club of a correlated set to have a wider groove than another golf club head 100 of a correlated set to attain certain shot goals.

It is noted that while both sole rails 114 and 116 are illustrated as having their own respective sole rail grooves 302 and 304, it is possible to have a golf club head 100 that has a sole rail groove present in only one of the sole rails 114, 116. An absence of the sole rail groove may be a function of player preference to affect how the sole rails 114 and 116 affect the performance of the golf club head 100 in various conditions. Different golf club heads 100 of a correlated set of golf club heads 100 may have any combination of sole rails with sole rail grooves depending on the particular goals of the golf club heads of the correlated set of golf club heads 100.

FIG. 4(*b*) illustrates a golf club head 100 having a hosel 110, a striking face 112, a heel sole rail 114 and a toe sole rail 116 present on the sole surface 126. The golf club head 100 also has a cavity 138 and a perimeter weighting element 140. The heel and toe sole rails 114, 116 have rearward most extents 156 and 146, respectively, and forward most extents 158 and 148, respectively. In this embodiment, the sole rails 114 and 116 have different sole lengths at least in part because of a player preference, but also because the heel portion of the golf club head 100 is narrower than the toe portion of the golf club head 100. The forwardmost extents 148 and 158 of the sole rails 114, 116 are positioned at the striking face 112. The rearward most extents 146, 156 wrap around the perimeter weighting element 140 of the golf club head 100. In this embodiment, the thickness of the sole rails 114, 116 are tapered from the rearwardmost portion of the sole rails 146, 156 toward the striking face 112 such that the forwardmost extent of the sole rails 158, 148 are gradually decreased to appear to be flush with the sole surface 126. Accordingly, the thickness generally decreases in thickness from the rearwardmost extent to the forwardmost extent. This tapering has an advantageous effect of reducing the amount of drag caused by the sole rails 114, 116 in their interaction with the turf. In this example, the heel and sole rails 114 and 116 terminate in tapered fashion in a region on the sole surface 126 that is somewhere between the striking face 112 and a rearward most extent of the sole surface 126. The tapered forwardmost extents of the sole rails 148, 158 are illustrated as being angular with respect to the striking face 112. The angled forwardmost extents of the sole rails 148, 158 have an effect on the amount of drag that is produced when the golf club head 100 interacts with the turf during a golf shot. The angled forwardmost extents help reduce drag such that an amount of club head speed that might be lost on account of a squared off tapered forwardmost extent is reduced.

The golf club head 100 illustrated in FIG. 4(*b*) also has toe and heel sole rail grooves 302 and 304. In this embodiment, the sole rail grooves 302 and 304 are present in a lower portion of the sole rails 116 and 114, and wrap around the perimeter weighting element 140 of the golf club head 100. The presence of the sole rail grooves has an effect of enabling more of the weight added to the golf club head 100 by the sole rails 114 and 116 to be moved toward the rear of the golf club head 100, which has an effect on the moment of inertia of the golf club head, as well as its center of gravity. The presence of the sole rail grooves 302, 304, may also have an effect on the amount of turf interaction experienced by the golf club head 100. The sole rail grooves 302 and 304 reduce the amount of surface area of the sole rails 114, 116 that comes in contact with the turf, thereby reducing an amount of drag that may be caused by any turf interaction. Such a reduction in drag may have an advantageous effect on any reduction in club head speed that may occur on account of the turf interaction. Because the sole rail grooves 302 and 304 terminate at a position that is on the perimeter weighting element, any drag induced by the sole rail grooves' 302, 304 termination on the sole surface 126 is eliminated.

The golf club head 100 further has a rail connector 306 that is positioned on the sole surface 126 of the golf club head 100 and/or the perimeter weighting element 140. The rail connector 306 connects the heel sole rail 114 to the toe sole rail 116. The rail connector 306 allows for weight to be added to the golf club head 100 such that the weight is further behind the cavity 138, and therefore lowers the center of gravity of the golf club head 100.

It is noted that while both sole rails 114 and 116 are illustrated as having their own respective sole rail grooves 302 and 304, it is possible to have a golf club head 100 that has a sole rail groove present in only one of the sole rails 114, 116. An absence of the sole rail groove may be a function of player preference to affect how the sole rails 114 and 116 affect the performance of the golf club head 100 in various conditions. Different golf club heads 100 of a correlated set of golf club heads 100 may have any combination of sole rails with sole rail grooves depending on the particular goals of the golf club heads of the correlated set of golf club heads 100.

FIG. 4(*c*) illustrates a golf club head 100 having a hosel 110, a striking face 112, a heel sole rail 114 and a toe sole rail 116 present on the sole surface 126. The golf club head 100 also has a cavity 138 and a perimeter weighting element 140. The heel and toe sole rails 114, 116 have rearward most extents 156 and 146, respectively, and forward most extents 158 and 148, respectively. In this embodiment, the sole rails 114 and 116 have different sole lengths at least in part because of a player preference, but also because the heel portion of the golf club head 100 is narrower than the toe portion of the golf club head 100. The forwardmost extents 148 and 158 of the sole rails 114, 116 are positioned at the striking face 112. The rearward most extents 146, 156 wrap around the perimeter weighting element 140 of the golf club head 100. In this embodiment, the thickness of the sole rails 114, 116 are tapered from the rearwardmost portion of the sole rails 146, 156 toward the striking face 112 such that the forwardmost extent of the sole rails 158, 148 are gradually decreased to appear to be flush with the sole surface 126. Accordingly, the thickness does generally decreases in thickness from the rearwardmost extent to the forwardmost extent. This tapering has an advantageous effect of reducing the amount of drag caused by the sole rails 114, 116 in their interaction with the turf. In this example, the heel and sole rails 114 and 116 terminate in tapered fashion in a region on the sole surface 126 that is somewhere between the striking face 112 and a rearward most extent of the sole surface 126. When compared to the golf club head 100 illustrated in FIG. 4(*b*), the sole rail length of the sole rails 114 and 116 is less than the sole rail lengths illustrated in FIG. 4(*b*). Such a reduction in sole rail length may occur between golf club heads 100 of a correlated set as the loft of golf club heads 100 increases. This reduction, as discussed above, occurs because the golf club head 100 having a greater loft often does not need as much help in achieving greater turf interaction, but some sole rail presence may be helpful in controlling the amount of turf interaction that occurs during a golf shot. The tapered forwardmost extents of the sole rails 148, 158 are illustrated as being angular with respect to the striking face 112. The angle forward most extents of the sole rails 148, 158 have an effect on the amount of drag that is produced when the golf club head 100 interacts with the turf during a golf shot. The angled forwardmost extents help reduce drag such that an amount of club head speed that might be lost on account of a squared off tapered forwardmost extent is reduced.

The golf club head 100 illustrated in FIG. 4(*e*) also has toe and heel sole rail grooves 302 and 304. In this embodiment, the sole rail grooves 302 and 304 are present in a lower portion of the sole rails 116 and 114, and terminate on the sole surface 126 of the golf club head 100. The presence of the sole rail grooves has an effect of enabling more of the weight added to the golf club head 100 by the sole rails 114 and 116 to be moved toward the rear of the golf club head 100, which has an effect on the moment of inertia of the golf club head, as well as its center of gravity. The presence of the sole rail grooves 302, 304, may also have an effect on the amount of turf interaction experienced by the golf club head 100. The sole rail grooves 302 and 304 reduce the amount of surface area of the sole rails 114, 116 that comes in contact with the turf, thereby reducing an amount of drag that may be caused by any turf interaction. Such a reduction in drag may have an advantageous effect on any reduction in club head speed that may occur on account of the turf interaction. Because the sole rail grooves 302 and 304 terminate at a position that is on the sole surface 126, any drag induced by the sole rail grooves' 302, 304 termination on the sole surface 126 is controlled to a desired level.

The golf club head 100 further has a rail connector 306 that is positioned on the sole surface 126 of the golf club head 100 and/or the perimeter weighting element 140. The rail connector 306 connects the heel sole rail 114 to the toe sole rail 116. The rail connector 306 allows for weight to be added to the golf club head 100 such that the weight is further behind the cavity 138, and therefore lowers the center of gravity of the golf club head 100.

It is noted that while both sole rails 114 and 116 are illustrated as having their own respective sole rail grooves 302 and 304, it is possible to have a golf club head 100 that has a sole rail groove present in only one of the sole rails 114, 116. An absence of the sole rail groove may be a function of player preference to affect how the sole rails 114 and 116 affect the performance of the golf club head 100 in various conditions. Different golf club heads 100 of a correlated set of golf club heads 100 may have any combination of sole rails with sole rail grooves depending on the particular goals of the golf club heads of the correlated set of golf club heads 100.

FIG. 4(*d*) illustrates a golf club head 100 having a hosel 110, a striking face 112, a heel sole rail 114 and a toe sole rail 116 present on the sole surface 126. The golf club head 100 also has a cavity 138 and a perimeter weighting element 140. The heel and toe sole rails 114, 116 have rearward most extents 156 and 146, respectively, and forward most extents 158 and 148, respectively. In this embodiment, the sole rails 114 and 116 have different sole lengths at least in part because of a player preference, but also because the heel portion of the golf club head 100 is narrower than the toe portion of the golf club head 100. The forwardmost extents 148 and 158 of the sole rails 114, 116 are positioned at the striking face 112. The rearward most extents 146, 156 wrap around the perimeter weighting element 140 of the golf club head 100. In this embodiment, the thickness of the sole rails 114, 116 are tapered from the rearwardmost portion of the sole rails 146, 156 toward the striking face 112 such that the forwardmost extent of the sole rails 158, 148 are gradually decreased to appear to be flush with the sole surface 126. Accordingly, the thickness does generally decreases in thickness from the rearwardmost extent to the forwardmost extent. This tapering has an advantageous effect of reducing the amount of drag caused by the sole rails 114, 116 in their interaction with the turf. In this example, the heel and sole rails 114 and 116 terminate in tapered fashion in a region on the sole surface 126 that is somewhere between the striking face 112 and a rearward most extent of the sole surface 126. When compared to the golf club head 100 illustrated in FIG. 4(*c*), the sole rail length of the sole rails 114 and 116 is less than the sole rail lengths illustrated in FIG. 4(*c*). Such a reduction in sole rails length may occur between golf club heads 100 of a correlated set as the loft of golf club heads 100 increases. This reduction, as discussed above, occurs because the golf club head 100 having a greater loft often does not need as much help in achieving greater turf interaction, but some sole rail presence may be helpful in controlling the amount of turf interaction that occurs during a golf shot. The tapered forwardmost extents of the sole rails 148, 158 are illustrated as being angular with respect to the striking face 112. The angle forward most extents of the sole rails 148, 158 have an effect on the amount of drag that is produced when the golf club head 100 interacts with the turf during a golf shot. The angled forwardmost extents help reduce drag such that an amount of club head speed that might be lost on account of a squared off tapered forwardmost extent is reduced.

The golf club head 100 illustrated in FIG. 4(*d*) also has toe and heel sole rail grooves 302 and 304. In this embodiment, the sole rail grooves 302 and 304 are present in a lower portion of the sole rails 116 and 114, and wrap around the perimeter weighting element 140 of the golf club head 100. The presence of the sole rail grooves has an effect of enabling more of the weight added to the golf club head 100 by the sole rails 114 and 116 to be moved toward the rear of the golf club head 100, which has an effect on the moment of inertia of the golf club head, as well as its center of gravity. The presence of the sole rail grooves 302, 304, may also have an effect on the amount of turf interaction experienced by the golf club head 100. The sole rail grooves 302 and 304 reduce the amount of surface area of the sole rails 114, 116 that comes in contact with the turf, thereby reducing an amount of drag that may be caused by any turf interaction. Such a reduction in drag may have an advantageous effect on any reduction in club head speed that may occur on account of the turf interaction. Because the sole rail grooves 302 and 304 terminate at a position that is on the perimeter weighting element, any drag induced by the sole rail grooves' 302, 304 termination on the sole surface 126 is eliminated.

The golf club head 100 further has a rail connector 306 that is positioned on the sole surface 126 of the golf club head 100 and/or the perimeter weighting element 140. The rail connector 306 connects the heel sole rail 114 to the toe sole rail 116. The rail connector 306 allows for weight to be added to the golf club head 100 such that the weight is further behind the cavity 138, and therefore lowers the center of gravity of the golf club head 100.

It is noted that while both sole rails 114 and 116 are illustrated as having their own respective sole rail grooves 302 and 304, it is possible to have a golf club head 100 that has a sole rail groove present in only one of the sole rails 114, 116. An absence of the sole rail groove may be a function of player preference to affect how the sole rails 114 and 116 affect the performance of the golf club head 100 in various conditions. Different golf club heads 100 of a correlated set of golf club heads 100 may have any combination of sole rails with sole rail grooves depending on the particular goals of the golf club heads of the correlated set of golf club heads 100.

Those skilled in the art will appreciate that while the present invention has been described in association with presently preferred aspects thereof, numerous changes, modifications and substitutions of equivalents may be made therein without departing from the spirit and scope of this invention which is intended to be unlimited by the foregoing except as may appear in the following appended claims.

What is claimed is:

1. A correlated set of golf club heads comprising:

a first club head that, when oriented in a reference position, includes:

a first loft angle;

a first heel portion;

a first toe portion opposite the first heel portion;

a first top portion; and a first sole portion comprising a first sole rail having a first setback length; and a second club head that, when oriented in the reference position, includes:

a second loft angle greater than the first loft angle;

a second heel portion;

a second toe portion opposite the second heel portion;

a second top portion;

a second sole portion comprising a second sole rail having a second setback length that is greater than the first setback length; and a difference between the first setback length and the second set back length is no less than about 2 mm.

2. The correlated set of claim 1, wherein:

a first difference between the first loft angle and the second loft angle is no greater than about 12 degrees.

3. The correlated set of claim 1, wherein:

the first sole portion further comprises a first bottom surface and a first rearward surface;

the second sole portion further comprises a second bottom surface and a second rearward surface; and at least one of: (a) the first sole rail comprises a maximum thickness proximate the first bottom surface no less than about 0.5 mm; and (b) the second sole rail comprises a maximum thickness proximate the second bottom surface no less than about 0.5 mm.

4. The correlated set of claim 1, wherein at least one of:

the first sole portion further comprises a first bottom surface and a first rearward surface, wherein the first sole rail is associated with the first bottom surface and the first rearward surface of the first sole portion; and the second sole portion further comprises a second bottom surface and a second rearward surface, wherein the second sole rail is associated with the second bottom surface and the second rearward surface of the second sole portion.

5. The correlated set of claim 1, wherein at least one of a first thickness of the first sole rail and a second thickness of the second sole rail forwardly tapers.

6. The correlated set of claim 1, wherein at least one of the first club head and the second club head comprise at least two discrete sole rails.

7. The correlated set of claim 1, wherein at least one of the first sole rail and the second sole rail further comprise a central groove generally extending in the forward to rearward direction.

8. The correlated set of claim 1, wherein:

the first sole portion further comprises a first bottom surface and a first rearward surface;

the second sole portion further comprise a second bottom surface and a second rearward surface;

the first sole rail comprises a first maximum thickness proximate the first bottom surface;

the second sole rail comprises a second maximum thickness proximate the second bottom surface such that a first absolute difference between the first maximum thickness and the second maximum thickness is no less than about 0.5 mm; and a second absolute difference between the first loft and the second loft is no greater than 12 degrees.

9. The correlated set of claim 1, wherein the second setback length is no less than about 5 mm.

10. The correlated set of claim 9, wherein the second setback length is no less than about 8 mm.

11. The correlated set of claim 9, wherein each of the first club head and the second club head comprise an iron-type club head.

12. The correlated set of claim 1, wherein:

each of the first club head and the second club head comprise an iron-type club head.

13. A correlated set of golf club heads comprising:

a first club head that, when oriented in a reference position, includes:

a first loft angle;

a first heel portion;

a first toe portion opposite the first heel portion;

a first striking face having a first striking face plane and a first forwardmost point;

a first top portion;

a first sole portion comprising a first rearwardmost point, a first sole length, and a first sole rail having a first sole rail forwardmost point and a first setback length, wherein the first sole length and the first setback length are measured in a first imaginary vertical plane perpendicular to the first striking face plane and passing through the first sole rail forwardmost point; and a first ratio of the first setback length to the first sole length; and a second club head that, when oriented in a reference position, includes:

a second loft angle greater than the first loft angle;

a second heel portion;

a second toe portion opposite the second heel portion;

a second striking face having a second striking face plane and a second forwardmost point;

a second top portion;

a second sole portion comprising a second rearwardmost point, a second sole length, and a second sole rail having a second sole rail forwardmost point and a second setback length, wherein the first sole length and the first setback length are measured in a second imaginary vertical plane perpendicular to the second striking face plane and passing through the second sole rail forwardmost point;

a second ratio of the second setback length to the second sole length, wherein the first ratio is less than the second ratio; and the first ratio is less than the second ratio by no less than about 0.10.

14. The correlated set of claim 13, wherein the second loft is greater than the first loft by no greater than about 12 degrees.

15. The correlated set of claim 14, wherein the first ratio is less than the second ratio by no less than about 0.20.

16. The correlated set of claim 13, wherein at least one of the first sole rail and the second sole rail has a maximum thickness no less than about 0.50 mm.

17. The correlated set of claim 13, wherein:

at least one of a first thickness of the first sole rail and a second thickness of the second sole rail forwardly tapers.

18. The correlated set of claim 13, wherein at least one of the first club head and the second club head comprises at least two discrete sole rails.

19. The correlated set of claim 13, wherein at least one of the first sole rail and the second sole rail further comprise a central groove generally extending in the forward to rearward direction.

20. A correlated set of golf club heads comprising:

a first club head that, when oriented in a reference position, includes:

a first loft angle;

a first heel portion;

a first toe portion opposite the first heel portion;

a first top portion; and a first sole portion comprising a first sole rail having a first setback length; and a second club head that, when oriented in the reference position, includes:

a second loft angle greater than the first loft angle;

a second heel portion;

a second toe portion opposite the second heel portion;

a second top portion;

a second sole portion comprising a second sole rail having a second setback length that is different from the first setback length;

wherein:

the first sole portion further comprises a first bottom surface and a first rearward surface;

the second sole portion further comprise a second bottom surface and a second rearward surface;

the first sole rail comprises a first maximum thickness proximate the first bottom surface;

the second sole rail comprises a second maximum thickness proximate the second bottom surface such that a first absolute difference between the first maximum thickness and the second maximum thickness is no less than about 0.5 mm; and a second absolute difference between the first loft and the second loft is no greater than 12 degrees.

* * * * *